US006374926B1

(12) United States Patent
Goldman et al.

(10) Patent No.: US 6,374,926 B1
(45) Date of Patent: Apr. 23, 2002

(54) METHOD OF ASSAYING DOWNHOLE OCCURRENCES AND CONDITIONS

(75) Inventors: William A. Goldman; Lee Morgan Smith, both of Houston, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 0 days.

(21) Appl. No.: 09/598,131

(22) Filed: Jun. 21, 2000

Related U.S. Application Data

(60) Division of application No. 09/048,360, filed on Mar. 26, 1998, now Pat. No. 6,131,673, which is a continuation-in-part of application No. 08/621,411, filed on Mar. 25, 1996, now Pat. No. 5,794,720.

(51) Int. Cl.[7] ..... E21B 45/00
(52) U.S. Cl. ..... 175/39; 175/40; 702/9
(58) Field of Search ..... 175/39, 40; 702/9; 73/152.48, 152.59

(56) References Cited

U.S. PATENT DOCUMENTS

| | | | | |
|---|---|---|---|---|
| 4,627,276 A | * | 12/1986 | Burgess et al. | 175/39 |
| 4,685,329 A | * | 8/1987 | Burgess | 73/152.44 |
| 4,852,399 A | * | 8/1989 | Falconer | 175/39 |
| 4,876,886 A | * | 10/1989 | Bible et al. | 175/39 |
| 4,926,686 A | * | 5/1990 | Fay | 73/152.48 |
| 4,926,950 A | * | 5/1990 | Zijsling | 175/39 |
| 4,928,521 A | * | 5/1990 | Jardine | 73/152.43 |
| 5,216,917 A | * | 6/1993 | Detournay | 73/152.59 |
| 5,305,836 A | * | 4/1994 | Holbrook et al. | 175/39 |

OTHER PUBLICATIONS

E. Detournay, P. Defourny; A phenomenological Model for the Drilling action of Drag Bits; pp. 13–23, International Journal of Rock Mechanics, mineral Sciences and Geomechanical Abstracts, vol. 29, No. 1, 1992, printed in Great Britain.*

T. M. Burgess, W. C. Lesso, Jr.; Measuring the Wear of Mille Tooth Bits using MWD Torque and Weight–on–Bit; SPE/IADC 13475, pp. 453–458 for pages illustration, published Mar. 1985, New Orleans, Louisiana.*

D. A. Glowka; Use of Single–Cutter Data in the Analysis of PDC Dit Designs: Part 2—Development and use of the PDCWEAR Computer Code; pp. 850–859, JPT (Aug. 1989).*

* cited by examiner

*Primary Examiner*—Hoang Dang
(74) *Attorney, Agent, or Firm*—Haynes and Boone, LLP; Michael J. Balconi-Lamica

(57) ABSTRACT

A method of assaying work of an earth boring bit of a given size and design comprises the steps of drilling a hole with the bit from an initial point to a terminal point. A plurality of electrical incremental actual force signals are generated, each corresponding to a force of the bit over a respective increment of the distance between the initial and terminal points. A plurality of electrical incremental distance signals are also generated, each corresponding to the length of the increment for a respective one of the incremental actual force signals. The incremental actual force signals and the incremental distance signals are processed to produce a value corresponding to the total work done by the bit in drilling from the initial point to the terminal point. Using such a basic work assay, a number of other downhole occurrences and/or conditions can be assayed. These include a wear rating for the type of bit, a determination of whether such a bit can drill a given interval of formation, and assessment of the abrasivity of rock drilled (which in turn can be used to modify the assays of other conditions and/or occurrences), a model of the wear of such a bit in current use, and a determination of the mechanical efficiency of the bit.

12 Claims, 6 Drawing Sheets

METHOD OF ASSAYING DOWNHOLE OCCURRENCES AND CONDITIONS

CROSS REFERENCE

This application is a divisional application of U.S. patent application Ser. No. 09/048,360, filed Mar. 26, 1998, now U.S. Pat. No. 6,131,673, which is a continuation-in-part of U.S. patent application Ser. No. 08/621,411 filed Mar. 25, 1996, now U.S. Pat. No. 5,794,720.

BACKGROUND OF THE INVENTION

From the very beginning of the oil and gas well drilling industry, as we know it, one of the biggest challenges has been the fact that it is impossible to actually see what is going on downhole. There are any number of downhole conditions and/or occurrences which can be of great importance in determining how to proceed with the operation. It goes without saying that all methods for attempting to assay such downhole conditions and/or occurrences are indirect. To that extent, they are all less than ideal, and there is a constant effort in the industry to develop simpler and/or more accurate methods.

In general, the approach of the art has been to focus on a particular downhole condition or occurrence and develop a way of assaying that particular thing. For example, U.S. Pat. No. 5,305,836, discloses a method whereby the wear of a bit currently in use can be electronically modeled, based on the lithology of the hole being drilled by that bit. This helps the operator know when it is time to replace the bit.

The process of determining what type of bit to use in a given part of a given formation has, traditionally, been, at best, based only on very broad, general considerations, and at worst, more a matter of art and guess work than of science.

Other examples could be given for other kinds of conditions and/or occurrences.

Furthermore, there are still other conditions and/or occurrences which would be helpful to know. However, because they are less necessary, and in view of the priority of developing better ways of assaying those things which are more important, little or no attention has been given to methods of assaying these other conditions.

SUMMARY OF THE INVENTION

Surprisingly, to applicant's knowledge, no significant attention has been given to a method for assaying the work a bit does in drilling a hole from an initial point to a terminal point. The present invention provides a very pragmatic method of doing so. The particular method of the present invention is relatively easy to implement, and perhaps more importantly, the work assay provides a common ground for developing assays of many other conditions and occurrences.

More specifically, a hole is drilled with a bit of the size and design in question from an initial point to a terminal point. As used herein, "initial point" need not (but can) represent the point at which the bit is first put to work in the hole. Likewise, the "terminal point" need not (but can) represent the point at which the bit is pulled and replaced. The initial and terminal points can be any two points between which the bit in question drills, and between which the data necessary for the subsequent steps can be generated.

In any event, the distance between the initial and terminal points is recorded and divided into a number of, preferably small, increments. A plurality of electrical incremental actual force signals, each corresponding to the force of the bit over a respective increment of the distance between the initial and terminal points, are generated. A plurality of electrical incremental distances signals, each corresponding to the length of the increment for a respective one of the incremental actual force signals, are also generated. The incremental actual force signals and the incremental distance signals are processed by a computer to produce a value corresponding to the total work done by the bit in drilling from the initial point to the terminal point.

In preferred embodiments of the invention, the work assay may then be used to develop an assay of the mechanical efficiency of the bit as well as a continuous rated work relationship between work and wear for the bit size and design in question. These, in turn, can be used to develop a number of other things.

For example, the rated work relationship includes a maximum-wear-maximum-work point, sometimes referred to herein as the "work rating," which represents the total amount of work the bit can do before it is worn to the point where it is no longer realistically useful. This work rating, and the relationship of which it is a part, can be used, along with the efficiency assay, in a process of determining whether a bit of the size and design in question can drill a given interval of formation. Other bit designs can be similarly evaluated, whereafter an educated, scientific choice can be made as to which bit or series of bits should be used to drill that interval.

Another preferred embodiment of the invention using the rated work relationship includes a determination of the abrasivity of the rock drilled in a given section of a hole. This, in turn, can be used to refine some of the other conditions assayed in accord with various aspects of the present invention, such as the bit selection process referred to above.

The rated work relationship can also be used to remotely model wear of a bit in current use in a hole, and the determination of abrasivity can be used to refine this modeling if the interval the bit is drilling is believed, e.g. due to experiences with nearby "offset wells," to contain relatively abrasive rock.

According to another embodiment of the present invention, work of the bit can be determined using bit mechanical efficiency, where the mechanical efficiency of the bit is based upon a percentage of a total torque applied by the bit which is cutting torque. As a result, effects of the operating torque of a drilling rig or apparatus, being used or considered for use in a particular drilling operation, on mechanical efficiency are then taken into account with respect to assaying the work of the bit. The present invention thus includes a bit work analysis method and apparatus, including a method for modeling bit mechanical efficiency, are disclosed herein below. The present invention is also implementable in the form of a computer program.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, where like reference numerals are used to identify like parts in the various views and in which.

DETAILED DESCRIPTION

Figure 1:
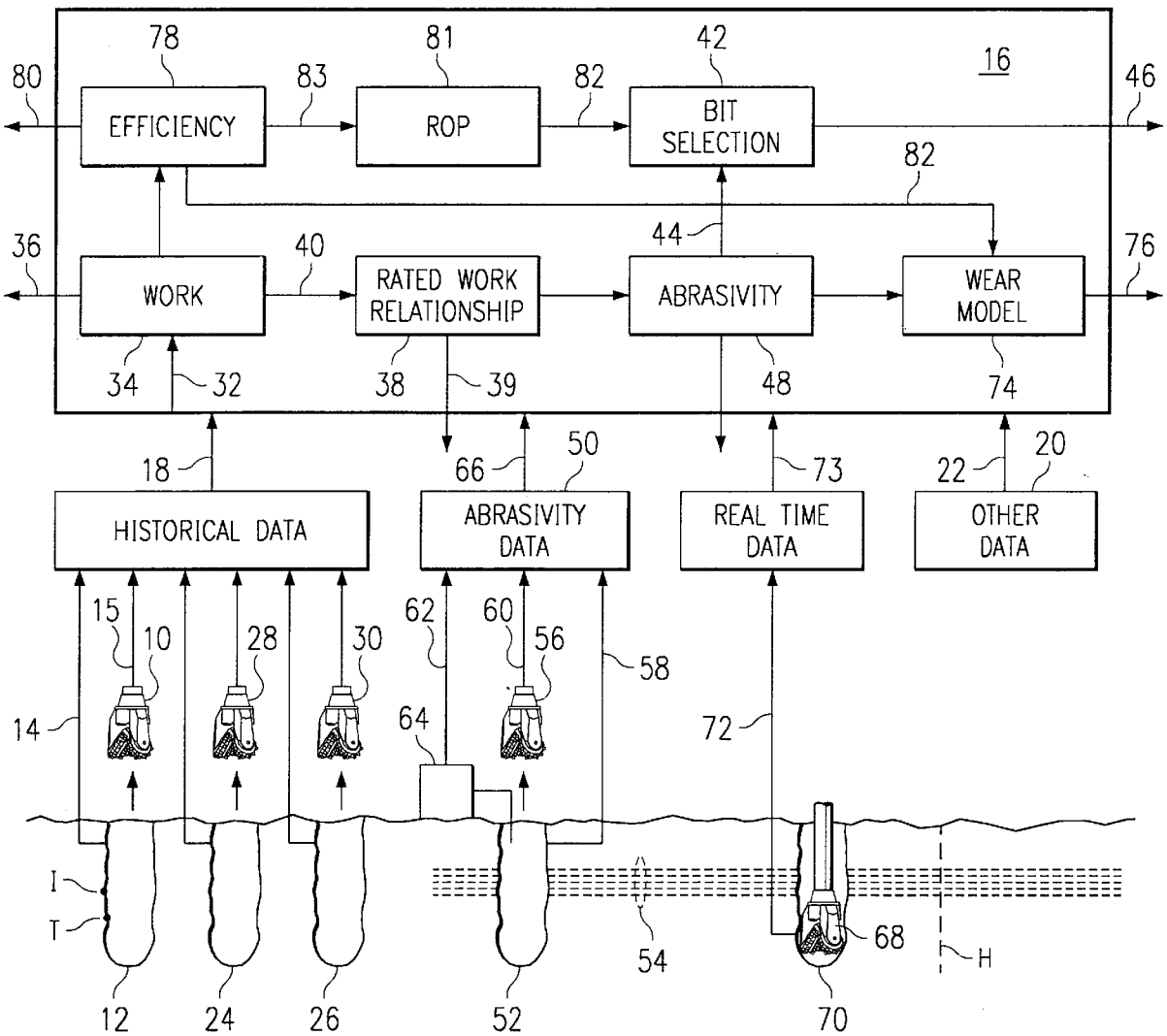
FIG. 1 is a diagram generally illustrating various processes which can be performed and a system for performing the processes in accord with the present invention.

Referring to FIG. 1, the most basic aspect of the present invention involves assaying work of a well drilling bit 10 of a given size and design. A well bore or hole 12 is drilled, at least partially with the bit 10. More specifically, bit 10 will have drilled the hole 12 between an initial point I and a terminal point T. In this illustrative embodiment, the initial point I is the point at which the bit 10 was first put to work in the hole 12, and the terminal point T is the point at which the bit 10 was withdrawn. However, for purposes of assaying work per se, points I and T can be any two points which can be identified, between which the bit 10 has drilled, and between which the necessary data, to be described below, can be generated.

The basic rationale is to assay the work by using the well known relationship:

$$\Omega_b = F_b D \tag{1}$$

where:

$\Omega_b$=bit work $F_b$=total force at the bit

D=distance drilled

The length of the interval of the hole 12 between points I and T can be determined and recorded as one of a number of well data which can be generated upon drilling the well 12, as diagrammatically indicated by the line 14. To convert it into an appropriate form for inputting into and processing by the computer 16, this length, i.e. distance between points I and T, is preferably subdivided into a number of small increments of distance, e.g. of about one-half foot each. For each of these incremental distance values, a corresponding electrical incremental distance signal is generated and inputted into the computer 16, as indicated by line 18. As used herein, in reference to numerical values and electrical signals, the term "corresponding" will mean "functionally related," and it will be understood that the function in question could, but need not, be a simple equivalency relationship. "Corresponding precisely to" will mean that the signal translates directly to the value of the very parameter in question.

In order to determine the work, a plurality of electrical incremental actual force signals, each corresponding to the force of the bit over a respective increment of the distance between points I and T, are also generated. However, because of the difficulties inherent in directly determining the total bit force, signals corresponding to other parameters from the well data 14, for each increment of the distance, are inputted, as indicated at 18. These can, theoretically, be capable of determining the true total bit force, which includes the applied axial force, the torsional force, and any applied lateral force. However, unless lateral force is purposely applied (in which case it is known), i.e. unless stabilizers are absent from the bottom hole assembly, the lateral force is so negligible that it can be ignored.

In one embodiment, the well data used to generate the incremental actual force signals are:

weight on bit (w), e.g. in lb.;

hydraulic impact force of drilling fluid ($F_i$), e.g. in lb.;

rotary speed, in rpm (N);

torque (T), e.g. in ft..lb.;

penetration rate (R), e.g. in ft./hr. and;

lateral force, if applicable ($F_l$), e.g. in lb.

With these data for each increment, respectively, converted to corresponding signals inputted as indicated at 18, the computer 16 is programmed or configured to process those signals to generate the incremental actual force signals to perform the electronic equivalent of solving the following equation:

$$\Omega_b = [(w+F_i)+120\ \pi NT/R+F_l]D \tag{2}$$

where the lateral force, $F_l$, is negligible, that term, and the corresponding electrical signal, drop out.

Surprisingly, it has been found that the torsional component of the force is the most dominant and important, and in less preferred embodiments of the invention, the work assay may be performed using this component of force alone, in which case the corresponding equation becomes:

$$\Omega_b = [120\ \pi NT/R]D \tag{3}$$

In an alternate embodiment, in generating the incremental actual force signals, the computer 16 may use the electronic equivalent of the equation:

$$\Omega_b = 2\ \pi T/d_c D \tag{4}$$

where d represents depth of cut per revolution, and is, in turn, defined by the relationship:

$$d_c = R/60N \tag{5}$$

The computer 16 is programmed or configured to then process the incremental actual force signals and the respective incremental distance signals to produce an electrical signal corresponding to the total work done by the bit 10 in drilling between the points I and T, as indicated at block 34. This signal may be readily converted to a humanly perceivable numerical value outputted by computer 16, as indicated by the line 36, in the well known manner.

The processing of the incremental actual force signals and incremental distance signals to produce total work 34 may be done in several different ways, as discussed further herein below.

In one version, the computer 16 processes the incremental actual force signals and the incremental distance signals to produce an electrical weighted average force signal corresponding to a weighted average of the force exerted by the bit between the initial and terminal points. By "weighted average" is meant that each force value corresponding to one or more of the incremental actual force signals is "weighted" by the number of distance increments at which that force applied. Then, the computer simply performs the electronic equivalent of multiplying the weighted average force by the total distance between points I and T to produce a signal corresponding to the total work value.

In another version, the respective incremental actual force signal and incremental distance signal for each increment are processed to produce a respective electrical incremental actual work signal, whereafter these incremental actual work signals are cumulated to produce an electrical total work signal corresponding to the total work value.

In still another version, the computer may develop a force/distance function from the incremental actual force signals and incremental distance signals, and then perform the electronic equivalent of integrating that function.

Not only are the three ways of processing the signals to produce a total work signal equivalent, they are also exemplary of the kinds of alternative processes which will be considered equivalents in connection with other processes forming various parts of the present invention, and described below.

Technology is now available for determining when a bit is vibrating excessively while drilling. If it is determined that this has occurred over at least a portion of the interval between points I and T, then it may be preferable to suitably program and input computer 16 so as to produce respective incremental actual force signals for the increments in question, each of which corresponds to the average bit force for the respective increment. This may be done by using the average (mean) value for each of the variables which go into the determination of the incremental actual force signal.

Wear of a drill bit is functionally related to the cumulative work done by the bit. In a further aspect of the present invention, in addition to determining the work done by bit 10 in drilling between points I and T, the wear of the bit 10 in drilling that interval is measured. A corresponding electrical wear signal is generated and inputted into the computer as part of the historical data 15, 18. (Thus, for this purpose, point I should be the point the bit 10 is first put to work in the hole 12, and point T should be the point at which bit 10 is removed.) The same may be done for additional wells 24 and 26, and their respective bits 28 and 30.

Figure 2:
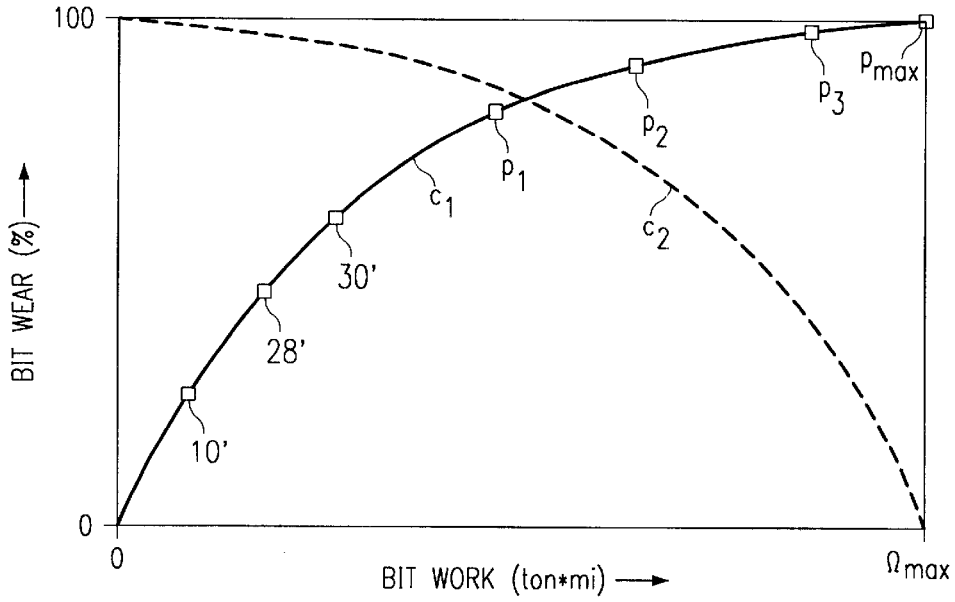
FIG. 2 is a graphic illustration of the rated work relationship.

FIG. 2 is a graphic representation of what the computer 16 can do, electronically, with the signals corresponding to such data. FIG. 2 represents a graph of bit wear versus work. Using the aforementioned data, the computer 16 can process the corresponding signals to correlate respective work and wear signals and perform the electronic equivalent of locating a point on this graph for each of the holes 12, 24 and 26, and its respective bit. For example, point 10' may represent the correlated work and wear for the bit 10, point 28' may represent the correlated work and wear for the bit 28, and point 30' may represent the correlated work and wear for the bit 30. Other points $p_1$, $p_2$ and $p_3$ represent the work and wear for still other bits of the same design and size not shown in FIG. 1.

By processing the signals corresponding to these points, the computer 16 can generate a function, defined by suitable electrical signals, which function, when graphically represented, takes the form of a smooth curve generally of the form of curve $c_1$ it will be appreciated, that in the interest of generating a smooth and continuous curve, such curve may not pass precisely through all of the individual points corresponding to specific empirical data. This continuous "rated work relationship" can be an output 39 in its own right, and can also be used in various other aspects of the invention to be described below.

It is helpful to determine an end point $p_{max}$ which represents the maximum bit wear which can be endured before the bit is no longer realistically useful and, from the rated work relationship, determining the corresponding amount of work. Thus, the point $p_{max}$ represents a maximum-wear-maximum-work point, sometimes referred to herein as the "work rating" of the type of bit in question. It may also be helpful to develop a relationship represented by the mirror image of curve $c_1$, i.e. curve $c_2$, which plots remaining useful bit life versus work done from the aforementioned signals.

The electrical signals in the computer which correspond to the functions represented by the curves $c_1$ and $c_2$ are preferably transformed into a visually perceptible form, such as the curves as shown in FIG. 2, when outputted at 39.

As mentioned above in another context, bit vibrations may cause the bit force to vary significantly over individual increments. In developing the rated work relationship, it is preferable in such cases, to generate a respective peak force signal corresponding to the maximum force of the bit over each such increment. A limit corresponding to the maximum allowable force for the rock strength of that increment can also be determined as explained below. For any such bit which is potentially considered for use in developing the curve $c_1$, a value corresponding to the peak force signal should be compared to the limit, and if that value is greater than or equal to the limit, the respective bit should be excluded from those from which the rated work relationship signals are generated. This comparison can, of course, be done electronically by computer 16, utilizing an electrical limit signal corresponding to the aforementioned limit.

The rationale for determining the aforementioned limit is based on an analysis of the bit power. Since work is functionally related to wear, and power is the rate of doing work, power is functionally related to (and thus an indication of) wear rate.

$$P = F_b D / t \tag{6}$$

$$= F_b R \tag{6a}$$

where t=time

R=penetration rate, a fundamental relationship also exists between penetration rate and power.

For adhesive and abrasive wear of rotating machine parts, published studies indicate that the wear rate is proportional to power up to a critical power limit above which the wear rate increases rapidly and becomes severe or catastrophic. The wear of rotating machine parts is also inversely proportional to the strength of the weaker material. The drilling process is fundamentally different from lubricated rotating machinery in that the applied force is always proportional to the strength of the weaker material.

Figure 7:
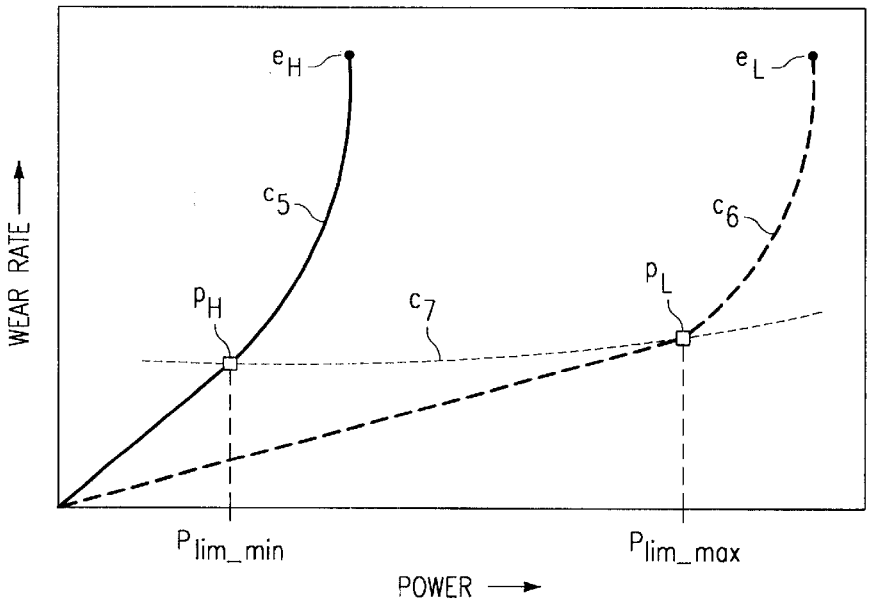
FIG. 7 is a graphic illustration of power limits.

In FIG. 7, wear rate for the bit design in question is plotted as a function of power for high and low rock compressive strengths in curves $c_5$ and $c_6$, respectively. It can be seen that in either case wear rate increases linearly with power to a respective critical point $p_H$ or $p_L$ beyond which the wear rate increases exponentially. This severe wear is due to increasing frictional forces, elevated temperature, and increasing vibration intensity (impulse loading). Catastrophic wear occurs at the ends $e_H$ and $e_L$ of the curves under steady state conditions, or may occur between $p_H$ and $e_H$ (or between $p_L$ and $e_L$) under high impact loading due to excessive vibrations. Operating at power levels beyond the critical points $p_H$, $p_L$ exposes the bit to accelerated wear rates that are no longer proportional to power and significantly increases the risk of catastrophic wear. A limiting power curve $c_7$ may be derived empirically by connecting the critical points at various rock strengths. Note that this power curve is also a function of cutter (or tooth) metallurgy and diamond quality, but these factors are negligible, as a practical matter. The curve $c_7$ defines the limiting power that avoids exposure of the bit to severe wear rates.

Once the limiting power for the appropriate rock strength is thus determined, the corresponding maximum force limit may be extrapolated by simply dividing this power by the rate of penetration.

Alternatively, the actual bit power could be compared directly to the power limit.

Of course, all of the above, including generation of signals corresponding to curves $c_5$, $c_6$ and $c_7$, extrapolation of a signal corresponding to the maximum force limit, and comparing the limit signal, may be done electronically by computer 16 after it has been inputted with signals corresponding to appropriate historical data.

Other factors can also affect the intensity of the vibrations, and these may also be taken into account in preferred embodiments. Such other factors include the ratio of weight on bit to rotary speed, drill string geometry and rigidity, hole geometry, and the mass of the bottom hole assembly below the neutral point in the drill string.

The manner of generating the peak force signal may be the same as that described above in generating incremental actual force signals for increments in which there is no vibration problem, i.e. using the electronic equivalents of equations (2), (3), or (4)+(5), except that for each of the variables, e.g. w, the maximum or peak value of that variable for the interval in question will be used (but for R, for which the minimum value should be used).

One use of the rated work relationship is in further developing information on abrasivity, as indicated at 48. Abrasivity, in turn, can be used to enhance several other aspects of the invention, as described below.

As for the abrasivity per se, it is necessary to have additional historical data, more specifically abrasivity data 50, from an additional well or hole 52 which has been drilled through an abrasive stratum such as "hard stringer" 54, and the bit 56 which drilled the interval including hard stringer 54.

It should be noted that, as used herein, a statement that a portion of the formation is "abrasive" means that the rock in question is relatively abrasive, e.g. quartz or sandstone, by way of comparison to shale. Rock abrasivity is essentially a function of the rock surface configuration and the rock strength. The configuration factor is not necessarily related to grain size, but rather than to grain angularity or "sharpness."

Turning again to FIG. 1, the abrasivity data 50 include the same type of data 58 from the well 52 as data 14, i.e. those well data necessary to determine work, as well as a wear measurement 60 for the bit 56. In addition, the abrasivity data include the volume 62 of abrasive medium 54 drilled by bit 56. The latter can be determined in a known manner by analysis of well logs from hole 62, as generally indicated by the black box 64.

As with other aspects of this invention, the data are converted into respective electrical signals inputted into the computer 16 as indicated at 66. The computer 16 quantifies abrasivity by processing the signals to perform the electronic equivalent of solving the equation:

$$\lambda=(\Omega_{rated}-\Omega_b)/V_{abr} \tag{7}$$

where:

$\lambda$=abrasivity $\Omega$=actual bit work (for amount of wear of bit 56)

$\Omega_{rated}$=rated work (for the same amount of wear)

$V_{abr}$=volume of abrasive medium drilled

Figure 3:
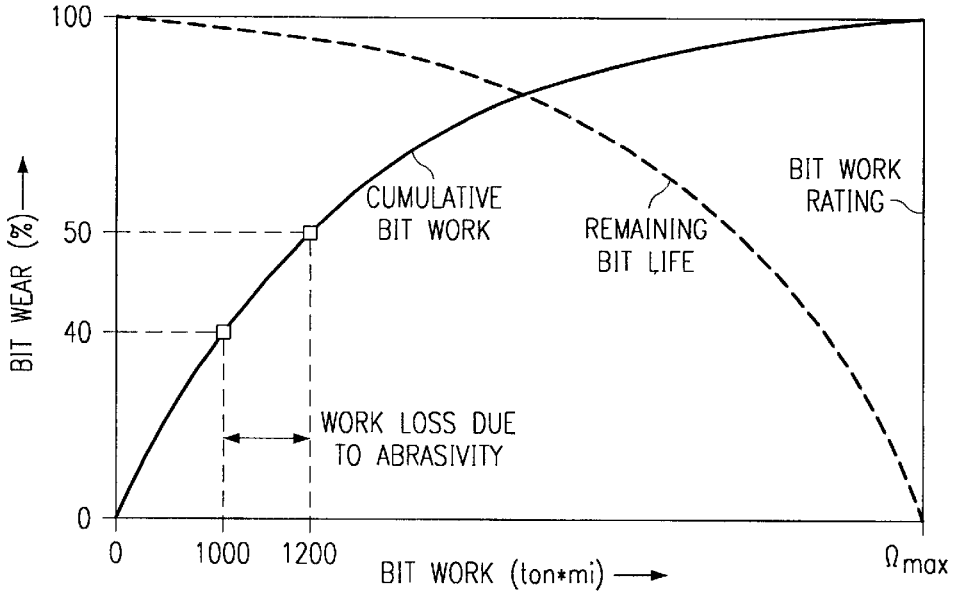
FIG. 3 is a graphic illustration of work loss due to formation abrasivity.

For instance, suppose that a bit has done 1,000 ton-miles of work and is pulled with 50% wear after drilling 200 cubic feet of abrasive medium. Suppose also that the historical rated work relationship for that particular bit indicates that the wear should be only 40% at 1,000 ton-miles and 50% at 1,200 ton-miles of work as indicated in FIG. 3. In other words, the extra 10% of abrasive wear corresponds to an additional 200 ton-miles of work. Abrasivity is quantified as a reduction in bit life of 200 ton-miles per 200 cubic feet of abrasive medium drilled or 1 (ton.mile/$ft^3$). This unit of measure is dimensionally equivalent to laboratory abrasivity tests. The volume percent of abrasive medium can be determined from well logs that quantify lithologic component fractions. The volume of abrasive medium drilled may be determined by multiplying the total volume of rock drilled by the volume fraction of the abrasive component. Alternatively, the lithological data may be taken from logs from hole 52 by measurement while drilling techniques as indicated by black box 64.

The rated work relationship 38 and, if appropriate, the abrasivity 48, can further be used to remotely model the wear of a bit 68 of the same size and design as bits 10, 28, 30 and 56 but in current use in drilling a hole 70. In the exemplary embodiment illustrated in FIG. 1, the interval of hole 70 drilled by bit 68 extends from the surface through and beyond the hard stringer 54.

Using measurement while drilling techniques, and other available technology, the type of data generated at 14 can be generated on a current basis for the well 70 as indicated at 72. Because this data is generated on a current basis, it is referred to herein as "real time data." The real time data is converted into respective electrical signals inputted into computer 16 as indicated at 73. Using the same process as for the historical data, i.e. the process indicated at 34, the computer can generate incremental actual force signals and corresponding incremental distance signals for every increment drilled by bit 68. Further, the computer can process the incremental actual force signals and the incremental distance signals for bit 68 to produce a respective electrical incremental actual work signal for each increment drilled by bit 68, and periodically cumulate these incremental actual work signals. This in turn produces an electrical current work signal corresponding to the work which has currently been done by bit 68. Then, using the signals corresponding to the rated work relationship 38, the computer can periodically transform the current work signal to an electrical current wear signal produced at 74 indicative of the wear on the bit in use, i.e. bit 68.

These basic steps would be performed even if the bit 68 was not believed to be drilling through hard stringer 54 or other abrasive stratum. Preferably, when the current wear signal reaches a predetermined limit, corresponding to a value at or below the work rating for the size and design bit in question, bit 68 is retrieved.

Because well 70 is near well 52, and it is therefore logical to conclude that bit 68 is drilling through hard stringer 54, the abrasivity signal produced at 48 is processed to adjust the current wear signal produced at 74 as explained in the abrasivity example above.

Once again, it may also be helpful to monitor for excessive vibrations of the bit 68 in use. If such vibrations are detected, a respective peak force signal should be generated, as described above, for each respective increment in which such excessive vibrations are experienced. Again, a limit corresponding to the maximum allowable force for the rock strength of each of these increments is also determined and a corresponding signal generated. Computer 16 electronically compares each such peak force signal to the respective limit signal to assay possible wear in excess of that corresponding to the current wear signal. Remedial action can be taken. For example, one may reduce the operating power level, i.e. the weight on bit and/or rotary speed.

In any case, the current wear signal is preferably outputted in some type of visually perceptible form as indicated at 76.

As indicated, preferred embodiments include real time wear modeling of a bit currently in use, based at least in part on data generated in that very drilling operation. However, it will be appreciated that, in less preferred embodiments, the work 54, rated work relationship 66, and/or abrasivity 68 generated by the present invention will still be useful in at least estimating the time at which the bit should be retrieved; whether or not drilling conditions, such as weight-on-bit, rotary speed, etc. should be altered from time to time; and the like. The same is true of efficiency 78, to be described more fully below, which, as also described more fully below, can likewise be used in generating the wear model 74.

In addition to the rated work relationship 38, the work signals produced at 34 can also be used to assay the mechanical efficiency of bit size and type 10, as indicated at 78.

Specifically, a respective electrical incremental minimum force signal is generated for each increment of a well interval, such as I to T, which has been drilled by bit 10. The computer 16 can do this by processing the appropriate signals to perform the electronic equivalent of solving the equation:

$$F_{min}=\sigma_i A_b \tag{8}$$

where:

$F_{min}$=minimum force required to drill increment $\sigma_i$=in-situ rock compressive strength $A_b$=total cross-sectional-area of bit The total in-situ rock strength opposing the total drilling force may be expressed as:

$$\sigma_i=f_t\sigma_{it}+f_a\sigma_{ia}+f_l\sigma_{il} \tag{9}$$

and, $$l=f_t+f_a+f_l \tag{10}$$

where:

$\sigma_i$=in-situ rock strength opposing the total bit force $f_t$=torsional fraction of the total bit force (applied force)

$\sigma_{it}$=in-situ rock strength opposing the torsional bit force $f_a$=axial fraction of the total bit force (applied force)

$\sigma_{ia}$=in-situ rock strength opposing the axial bit force $f_l$=lateral fraction of the total bit force (reactive force, often zero mean value, negligible with BHA stabilization)

$\sigma_{il}$=in-situ rock strength opposing the lateral bit force.

Since the torsional fraction dominates the total drilling force (i.e. $f_t$ is approximately equal to 1), in the in-situ rock strength is essentially equal to the torsional rock strength, or $\sigma_i=\sigma_{it}$.

A preferred method of modeling $\sigma_i$ is explained in the present inventors' copending application Ser. No. 08/621,412, entitled "Method of Assaying Compressive Strength of Rock," filed contemporaneously herewith, and incorporated herein by reference.

The minimum force signals correspond to the minimum force theoretically required to fail the rock in each respective increment, i.e. hypothesizing a bit with ideal efficiency.

Next, these incremental minimum force signals and the respective incremental distance signals are processed to produce a respective incremental minimum work signal for each increment, using the same process as described in connection with box 34.

Finally, the incremental actual work signals and the incremental minimum work signals are processed to produce a respective electrical incremental actual efficiency signal for each increment of the interval I-T (or any other well increment subsequently so evaluated). This last step may be done by simply processing said signals to perform the electronic equivalent of taking the ratio of the minimum work signal to the actual work signal for each respective increment.

It will be appreciated, that in this process, and many of the other process portions described in this specification, certain steps could be combined by the computer 16. For example, in this latter instance, the computer could process directly from those data signals which have been described as being used to generate force signals, and then—in turn—work signals, to produce the efficiency signals, and any such "short cut" process will be considered the equivalent of the multiple steps set forth herein for clarity of disclosure and paralleled in the claims, the last-mentioned being one example only.

As a practical matter, computer 16 can generate each incremental actual efficiency signal by processing other signals already defined herein to perform the electronic equivalent of solving the following equation:

$$E_b=(\sigma_{it}f_t+\sigma_{ia}f_a+\sigma_{il}f_l)A_b/(2\,\pi T/d_c+w+F_t+f_l) \tag{11}$$

However, although equation 11 is entirely complete and accurate, it represents a certain amount of overkill, in that some of the variables therein may, as a practical matter, be negligible. Therefore, the process may be simplified by dropping out the lateral efficiency, resulting in the equation:

$$E_b=(\sigma_{it}f_t+\sigma_{ia}f_a)A_b/(2\,\pi T/d_c+w+F_t) \tag{12}$$

or even further simplified by also dropping out axial efficiency and other negligible terms, resulting in the equation:

$$E_b=\sigma_{it}(d_c/T)(A_b/2\,\pi) \tag{13}$$

Other equivalents to equation (11) include:

$$E_b=A_b(\sigma_{it}f_t^2/F_t+\sigma_{ia}f_a^2/F_a+\sigma_{il}f_l^2/F_l) \tag{14}$$

The efficiency signals may be outputted in visually perceptible form, as indicated at 80.

As indicated by line 82, the efficiency model can also be used to embellish the real time wear modeling 74, described above. More particularly, the actual or real time work signals for the increments drilled by bit 68 may be processed with respective incremental minimum work signals from reference hole 52 to produce a respective electrical real time incremental efficiency signal for each such increment of hole 70, the processing being as described above. As those of skill in the art will appreciate (and as is the case with a number of the sets of signals referred to herein) the minimum work signals could be produced based on real time data from hole 70 instead of, or in addition to, data from reference hole 52.

These real time incremental efficiency signals are compared, preferably electronically by computer 16, to the respective incremental "actual" efficiency signals based on prior bit and well data. If the two sets of efficiency signals diverge over a series of increments, the rate of divergence can be used to determine whether the divergence indicates a drilling problem, such as catastrophic bit failure or balling up, on the one hand, or an increase in rock abrasivity, on the other hand. This could be particularly useful in determining, for example, whether bit 68 in fact passes through hard stringer 54 as anticipated and/or whether or not bit 68 passes through any additional hard stringers. Specifically, if the rate of divergence is high, i.e. if there is a relatively abrupt change, a drilling problem is indicated. On the other hand, if the rate of divergence is gradual, an increase in rock abrasivity is indicated.

A decrease in the rate of penetration (without any change in power or rock strength) indicates that such an efficiency divergence has begun. Therefore, it is helpful to monitor the rate of penetration while bit 68 is drilling, and using any decrease(s) in the rate of penetration as a trigger to so compare the real time and actual efficiency signals.

Figure 4:
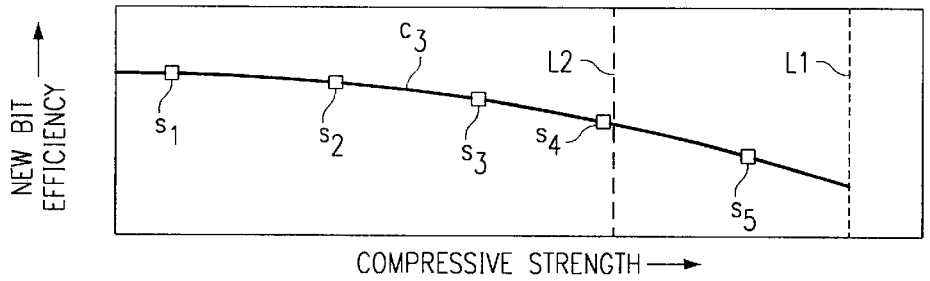
FIG. 4 is a graphic illustration of a relationship between rock compressive strength and bit efficiency.
Figure 5:
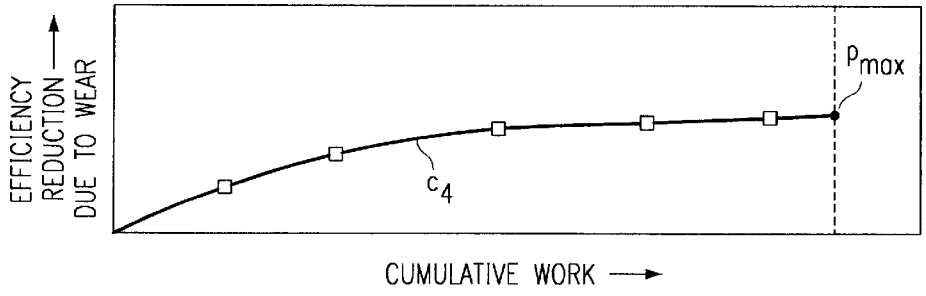
FIG. 5 is a graphic illustration of a relationship between cumulative work done by a bit and reduction in the efficiency of that bit due to wear.

Efficiency 78 can also be used for other purposes, as graphically indicated in FIGS. 4 and 5. Referring first to FIG. 4, a plurality of electrical compressive strength signals, corresponding to difference rock compressive strengths actually experienced by the bit, may be generated. Each of these compressive strength signals is then correlated with one of the incremental actual efficiency signals corresponding to actual efficiency of the bit in an increment having the respective rock compressive strength. These correlated signals are graphically represented by points $s_1$ through $s_5$ in FIG. 4. By processing these, computer 16 can extrapolate one series of electrical signals corresponding to a continuous efficiency-strength relationship, graphically represented by the curve $c_3$, for the bit size and design in question. In the interest of extrapolating a smooth and continuous function $c_3$, it may be that the curve $c_3$ does not pass precisely through each of the points from which it was extrapolated, i.e. that the one series of electrical signals does not include precise correspondents to each pair of correlated signals $s_1$ through $s_5$.

Through known engineering techniques, it is possible to determine a rock compressive strength value, graphically represented by $L_1$, beyond which the bit design in question cannot drill, i.e. is incapable of significant drilling action and/or at which bit failure will occur. The function $c_3$ extrapolated from the correlated signals may be terminated at the value represented by $L_1$. In addition, it may be helpful, again using well known engineering techniques, to determine a second limit or cutoff signal, graphically represented by $L_2$, which represents an economic cutoff, i.e. a compressive strength beyond which it is economically impractical to drill, e.g. because the amount of progress the bit can make will not justify the amount of wear. Referring also to FIG. 5, it is possible for computer 16 to extrapolate, from the incremental actual efficiency signals and the one series of signals represented by curve $c_3$, another series of electrical signals, graphically represented by curve $c_4$ in FIG. 5, corresponding to a continuous relationship between cumulative work done and efficiency reduction due to wear for a given rock strength. This also may be developed from historical data. The end point $p_{max}$, representing the maximum amount of work which can be done before bit failure, is the same as the like-labeled point in FIG. 2. Other curves similar to $C_4$ could be developed for other rock strengths in the range covered by FIG. 4.

Referring again to FIG. 1, it is also possible for computer 16 to process signals already described to produce a signal corresponding to the rate of penetration, abbreviated "ROP," and generally indicated at 81. As mentioned above, there is a fundamental relationship between penetration rate and power. This relationship is, more specifically, defined by the equation:

$$R=P_{lim}E_b/\sigma_r A_b \tag{15}$$

it will be appreciated that all the variables in this equation from which the penetration rate, R, are determined, have already been defined, and in addition, will have been converted into corresponding electrical signals inputted into computer 16. Therefore, computer 16 can determine penetration rate by processing these signals to perform the electronic equivalent of solving equation 15.

The most basic real life application of this is in predicting penetration rate, since means are already known for actually measuring penetration rate while drilling. One use of such a prediction would be to compare it with the actual penetration rate measured while drilling, and if the comparison indicates a significant difference, checking for drilling problems.

A particularly interesting use of the rated work relationship 38, efficiency 78 and its corollaries, and ROP 81 is in determining whether a bit of the design in question can drill a significant distance in a given interval of formation, and if so, how far and/or how fast. This can be expanded to assess a number of different bit designs in this respect, and for those bit designs for which one or more of the bits in question can drill the interval, an educated bit selection 42 can be made on a cost-per-unit-length-of-formation-drilled basis. The portion of the electronic processing of the signals involved in such determinations of whether or not, or how far, a bit can drill in a given formation, are generally indicated by the bit selection block 42 in FIG. 1. The fact that these processes utilize the rated work relationship 38, efficiency 78, and ROP 81 is indicated by the lines 44, 83, and 82, respectively. The fact that these processes result in outputs is indicated by the line 46.

Figure 6:
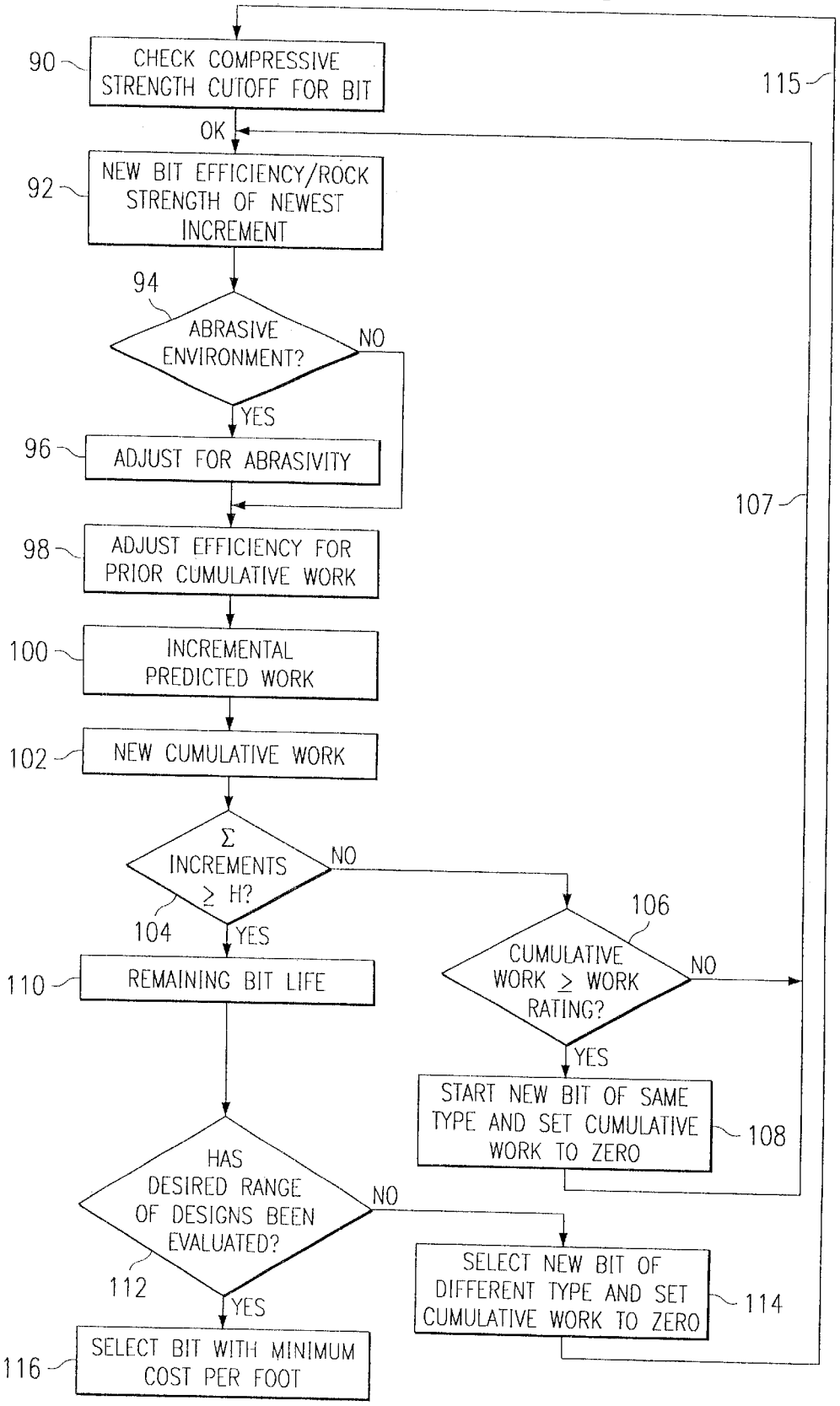
FIG. 6 is diagram generally illustrating a bit selection process.

FIG. 6 diagrams a decision tree, interfaced with the processes which can be performed by computer 16 at 42, for a preferred embodiment of this aspect of the invention. The interval of interest is indicated by the line H in FIG. 1, and due to its proximity to holes 52 and 70, presumptively passes through hard stringer 54.

First, as indicated in block 90, the maximum rock compressive strength for the interval H of interest is compared to a suitable limit, preferably the value at $L_2$ in FIG. 4, for the first bit design to be evaluated. The computer 16 can do this by comparing corresponding signals. If the rock strength in the interval H exceeds this limit, then the bit design in question is eliminated from consideration. Otherwise, the bit has "O.K." status, and we proceed to block 92. The interval H in question will have been subdivided into a number of very small increments, and corresponding electrical signals will have been inputted into the computer 16. For purposes of the present discussion, we will begin with the first two such increments. Through the processes previously described in connection with block 78 in FIG. 1, an efficiency signal for a new bit of the first type can be chosen for the rock strength of the newest increment in interval H, which in this early pass will be the second of the aforementioned two increments.

Preferably, computer 16 will have been programmed so that those increments of interval H which presumptively pass through hard stringer 54 will be identifiable. In a process diagrammatically indicated by block 94, the computer determines whether or not the newest increment, here the second increment, is abrasive. Since the second increment will be very near the surface or upper end of interval H, the answer in this pass will be "no."

The process thus proceeds directly to block 98. If this early pass through the loop is the first pass, there will be no value for cumulative work done in preceding increments. If, on the other hand, a first pass was made with only one increment, there may be a value for the work done in that first increment, and an adjustment of the efficiency signal due to efficiency reduction due to that prior work may be done at block 98 using the signals diagrammatically indicated in FIG. 5. However, even in this latter instance, because the increments are so small, the work and efficiency reduction from the first increment will be negligible, and any adjustment made is insignificant.

As indicated at block 99, the computer will then process the power limit, efficiency, in situ rock strength, and bit cross sectional area signals, to model the rate of penetration for the first two increments (if this is the very first pass through the loop) or for the second increment (if a first pass was made using the first increment only). In any case, each incremental ROP signal may be stored. Alternatively, each incremental ROP signal may be transformed to produce a corresponding time signal, for the time to drill the increment in question, and the time signals may be stored. It should be understood that this step need not be performed just after step box 98, but could, for example, be performed between step boxes 102 and 104, described below.

Next, as indicated at block 100, the computer will process the efficiency signals for the first two increments (or for the second increment if the first one was so processed in an earlier pass) to produce respective electrical incremental predicted work signals corresponding to the work which would be done by the bit in drilling the respective increments. This can be done, in essence, by a reversal of the process used to proceed from block 34 to block 78 in FIG. 1.

As indicated at block 102, the computer then cumulates the incremental predicted work signals for these first two increments to produce a cumulative predicted work signal.

As indicated at block 104, signals corresponding to the lengths of the first two increments are also cumulated and electronically compared to the length of the interval H. For the first two increments, the sum will not be greater than or equal to the length of H, so the process proceeds to block 106. The computer will electronically compare the cumulative work signal determined at block 102 with a signal corresponding to the work rating, i.e. the work value for $p_{max}$ (FIG. 2) previously determined at block 38 in FIG. 1. For the first two increments, the cumulative work will be negligible, and certainly not greater than the work rating. Therefore, as indicated by line 109, we stay in the main loop and return to block 92 where another efficiency signal is generated based on the rock strength of the next, i.e. third, increment. The third increment will not yet be into hard stringer 54, so the process will again proceed directly from block 94 to block 98. Here, the computer will adjust the efficiency signal for the third increment based on the prior cumulative work signal generated at block 102 in the preceding pass through the loop, i.e. adjusting for work which would be done if the bit had drilled through the first two increments. The process then proceeds as before.

For those later increments, however, which do lie within hard stringer 54, the programming of computer 16 will, at the point diagrammatically indicated by block 94, trigger an adjustment for abrasivity, based on signals corresponding to data developed as described hereinabove in connection with block 48 in FIG. 1, before proceeding to the adjustment step 98.

If, at some point, the portion of the process indicated by block 106 shows a cumulative work signal greater than or equal to the work rating signal, we know that more than one bit of the first design will be needed to drill the interval H. At this point, in preferred embodiments, as indicated by step block 107, the stored ROP signals are averaged and then processed to produce a signal corresponding to the time it would have taken for the first bit to drill to the point in question. (If the incremental ROP signals have already been converted into incremental time signals, then, of course, the incremental time signals will simply be summed.) In any event, we will assume that we are now starting another bit of this first design, so that, as indicated by block 108, the cumulative work signal will be set back to zero before proceeding back to block 92 of the loop.

On the other hand, eventually either the first bit of the first design or some other bit of that first design will result in an indication at block 104 that the sum of the increments is greater than or equal to the length of the interval H, i.e. that the bit or set of bits has hypothetically drilled the interval of interest. In this case, the programming of computer 16 will cause an appropriate indication, and will also cause the process to proceed to block 110, which diagrammatically represents the generation of a signal indicating the remaining life of the last bit of that design. This can be determined from the series of signals diagrammatically represented by curve $c_2$ in FIG. 2.

Next, as indicated by step block 111, the computer performs the same function described in connection with step block 107, i.e. produce a signal indicating the drilling time for the last bit in this series (of this design).

Next, as indicated by block 112, the operator will determine whether or not the desired range of designs has been evaluated. As described thus far, only a first design will have been evaluated. Therefore, the operator will select a second design, as indicated at block 114. Thus, not only is the cumulative work set back to zero, as in block 108, but signals corresponding to different efficiency data, rated work relationship, abrasivity data, etc., for the second design will be inputted, replacing those for the first design, and used in restarting the process. Again, as indicated by 115, the process of evaluating the second design will proceed to the main loop only if the compressive strength cutoff for the second design is not exceeded by the rock strength within the interval H.

At some point, at block 112, the operator will decide that a suitable range of bit designs has been evaluated. We then proceed to block 116, i.e. to select the bit which will result in the minimum cost per foot for drilling interval H. It should be noted that this does not necessarily mean a selection of the bit which can-drill the farthest before being replaced. For example, there may be a bit which can drill the entire interval H, but which is very expensive, and a second bit design, for which two bits would be required to drill the interval, but with the total cost of these two bits being less than the cost of one bit of the first design. In this case, the second design would be chosen.

More sophisticated permutations may be possible in instances where it is fairly certain that the relative abrasivity in different sections of the interval will vary. For example, if it will take at least three bits of any design to drill the interval H, it might be possible to make a selection of a first design for drilling approximately down to the hard stringer 54, a second and more expensive design for drilling through hard stringer 54, and a third design for drilling below hard stringer 54.

The above describes various aspects of the present invention which may work together to form a total system. However, in some instances, various individual aspects of the invention, generally represented by the various blocks within computer 16 in FIG. 1, may be beneficially used without necessarily using all of the others. Furthermore, in connection with each of these various aspects of the invention, variations and simplifications are possible, particularly in less preferred embodiments.

In accordance with an another embodiment of the present invention, an alternate method for determining bit mechanical efficiency is provided. This alternate method of determining bit mechanical efficiency is in addition to the method of determining bit mechanical efficiency previously presented herein above. In conjunction with assaying the work of a bit of given size and design in the drilling of an interval of a rock formation, bit mechanical efficiency may also be defined as a percentage of the total torque applied by the bit that actually drills the rock formation. This definition of bit mechanical efficiency forms the basis for a torque—bit mechanical efficiency model for assaying work of a bit of given size and design.

To better understand this alternate embodiment, let us first review for a moment how bit mechanical efficiency has been traditionally described in the art. Mechanical efficiency has been described in the art as the ratio of the inherent strength of a rock over the force applied by a bit to drill through the rock. This definition of mechanical efficiency may be mathematically expressed as follows:

$$E_1=\sigma A/F \tag{16}$$

where:
$E_1$=prior art bit mechanical efficiency (fractional);
$\sigma$=rock compressive strength (lbf/in$^2$, or psi);
A=cross-sectional area of the bit (in$^3$); and
F=drilling force applied by the bit (lbf).
In addition, bit force may be mathematically expressed as follows:

$$F=120\ \pi NT_t/R \tag{17}$$

where:
F=drilling force applied by the bit (lbf);
N=bit rotary speed (rpm);
$T_t$=total torque applied by the bit (ft.lbf); and
R=bit penetration rate (ft/hr).

As mentioned above, the method of determining bit mechanical efficiency according to the alternate embodiment of the present invention includes defining bit mechanical efficiency as a percentage of the total torque applied by the bit that actually drills the rock. This definition of bit mechanical efficiency is expressed as follows:

$$E_2=T_c/T_t \tag{18}$$

where:
$E_2$=equivalent bit mechanical efficiency (fractional);
$T_c$=cutting torque applied by the bit (ft.lbf); and
$T_t$=total torque applied by the bit (ft.lbf).
The bit mechanical efficiency model according to the alternate embodiment of the present invention recognizes the fact that a portion of the total torque is dissipated as friction, or $$T_t=T_c+T_f \tag{19}$$

where:
$T_f$=frictional torque dissipated by the bit (ft.lbf).

The preceding two definitions of bit mechanical efficiency can be shown to be mathematically equivalent definitions, that is, $E_2=E_1$. To prove that the two are mathematically equivalent, let us consider the following discussion.

When bit mechanical efficiency is one hundred percent (100%), then it follows logically that the bit frictional torque must be zero. That is, when E=1, then $T_f$=0, and therefore the total torque equals the cutting torque ($T_t=T_c$).

Substituting these values into equations (16) and (17) for bit mechanical efficiency yields:

$$E_1=1=\sigma AR/120\ \pi NT_t=\sigma AR/120\ NT_c \tag{20}$$

Solving for $T_c$ yields:

$$T_c=(\sigma AR/120N) \tag{21}$$

Substituting this expression for $T_c$ into equation (20) yields:

$$E_1=(\sigma AR/120\ N).(1/T_t)=T_c/T_t=E_2 \tag{22}$$

Therefore, $E_2=E_1$, and the two definitions of bit efficiency are mathematically equivalent.

Figure 8:
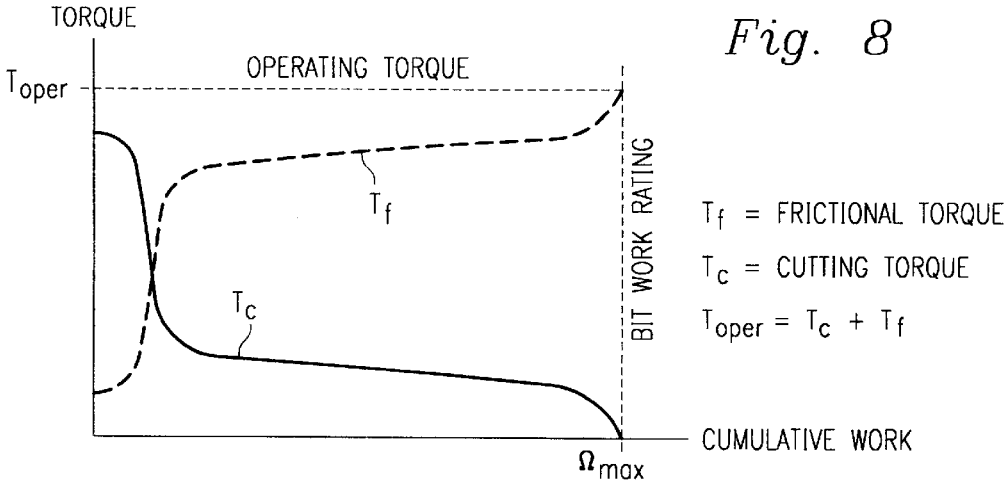
FIG. 8 is a graphic illustration of a relationship between cumulative work done by a bit and torque, further for illustrating the effect of bit wear on torque.

Turning now to FIG. 8, the effect of bit wear on torque shall be discussed. For a bit of given size and design, the illustration shows the relationship between torque and cumulative work done by the bit. The cumulative work scale extends from zero cumulative work up to the cumulative work $\Omega_{max}$ of the bit. Recall that the wear of a drill bit is functionally related to the cumulative work done by the bit. The cumulative work $\Omega_{max}$ thus corresponds to the point at which the bit has endured a maximum bit wear. Beyond $\Omega_{max}$, the bit is no longer realistically useful.

From FIG. 8, torque is shown as including a cutting torque (i.e., the percentage of total torque which is cutting torque) and a frictional torque (i.e., the percentage of total torque which is frictional torque). Cutting torque ($T_c$) is torque which cuts the rock of a given formation. Frictional torque ($T_f$) is torque which is dissipated as friction. Torque is further a function of an operating torque ($T_{oper}$) of the particular drilling rig or drilling apparatus which is applying torque to the bit. The operating torque is further limited by a maximum safe operating torque of the particular drilling rig or drilling apparatus. As will become further apparent from the discussion below, the torque—bit mechanical efficiency model according to the alternate embodiment of the present invention recognizes previously unknown effects of drilling rig operating torque upon bit mechanical efficiency. In FIG. 8, for any given point along the cumulative work alas up to $\Omega_{max}$, the operating torque is equal to the sum of the cutting torque plus the frictional torque. As the cumulative work of the bit increases from zero to $\Omega_{max}$, the percentage of cutting torque decreases as the percentage of frictional torque increases. The percentage of cutting torque to frictional torque varies further in accordance with the geometries of the given bit, weight-on-bit, rock compressive strength, and other factors, as will be explained further herein below. Beyond the maximum work rating, $\Omega_{max}$, for a bit of given size and design, cutting torque is a minimum and frictional torque is a maximum.

As discussed herein, computer 16 of the analysis system of the present invention provides various signal outputs. In addition, the present invention further contemplates providing visually perceptible outputs, such as in the form of a display output, soft copy output, or hard copy output. Such visually perceptable outputs may include information as shown in the various figures of the present application. For example, the effect of bit wear on torque may be displayed on a computer display terminal or computer print out as a plot of torque versus cumulative work done by a bit, such as shown in FIG. 8. Another output may include a display or print out of a plot of mechanical efficiency of a bit as a function of cumulative work done. Still further, the display or printout may include a plot of mechanical efficiency as a function of depth of a down hole being drilled. Other bit work-wear characteristics and parameters may also be plotted as a function of depth of the down hole being drilled.

Figure 9:
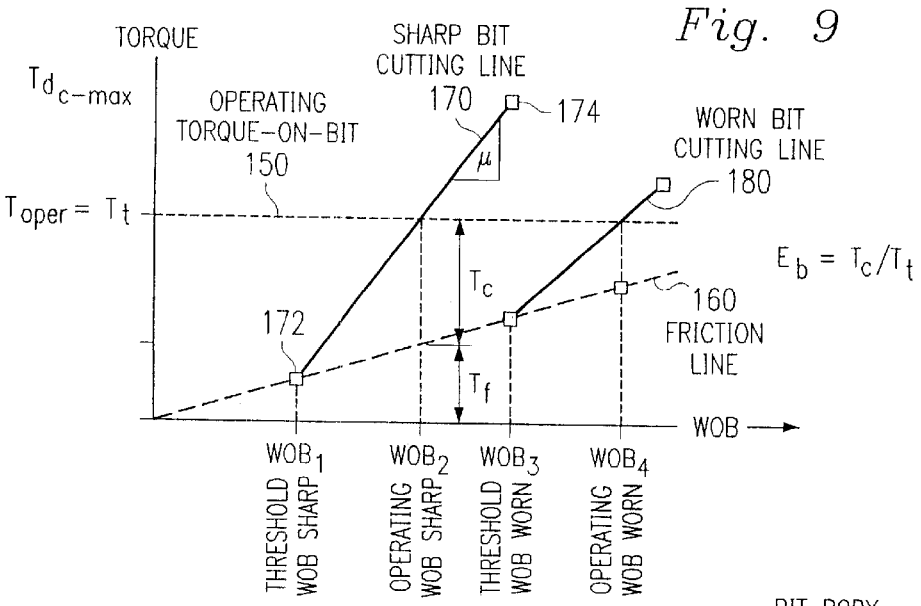
FIG. 9 illustrates a relationship between weight-on-bit (WOB) and torque according to a torque—bit mechanical efficiency model of an alternate embodiment of the present invention.

Referring now to FIG. 9, a graph of torque versus weight-on-bit (WOB) for a bit of given size and design for drilling a rock formation of a given rock compressive strength is illustrated and will be further explained herein below. The torque versus WOB graph may also be referred to as the torque versus WOB characteristic model of the bit of given size and design. Still further, the torque versus WOB characteristic model may also be referred to as a torque-mechanical efficiency model of the bit of given size and design for a given rock compressive strength.

Operating torque $T_{oper}$ is illustrated in FIG. 9 as indicated by the reference numeral 150. Operating torque is the torque provided to the bit from a particular drilling rig (not shown) or drilling apparatus being used, or under consideration for use, in a drilling operation. The operating torque of a drilling rig or drilling apparatus is limited by mechanical limitations of the specific rig or apparatus, further by a maximum safe operating torque of the particular rig or apparatus. As mentioned above, operating torque of the particular drilling rig has an effect upon bit mechanical efficiency, as can be further understood from the discussion herein below.

Limiting torque values for the torque versus WOB characteristic model may be determined from historical empirical data (i.e., well logs showing torque measurements), from laboratory tests, or calculated. For instance, a limiting torque value $T_{dc\text{-}MAX}$ can be determined by the torque at which a maximum depth of cut is reached by critical cutters of the given bit. The maximum depth of cut corresponds to the condition of the cutting structure being fully embedded into the rock being cut. Data for determining $T_{dc\text{-}MAX}$ can be obtained by laboratory tests. Alternatively, the torque $T_{dc\text{-}MAX}$ can be calculated from the relationship between downward force applied to the bit (WOB), axial projected contact area, and rock compressive strength as expressed in equation (25) below and a computer simulation solving for torque in equation (23) below, as will be discussed further herein. In addition, in an actual drilling operation in the field, $T_{dc}$ may also be determined by beginning to drill at a fixed rotary speed and minimal weight-on-bit, then gradually increasing the weight-on-bit while monitoring a total torque and penetration rate. Penetration rate will increase with weight-on-bit to a point at which it will level off, or even drop, wherein the torque at that point is $T_{dc}$. For any given total torque value represented via an electrical signal, it is possible to process a corresponding electrical signal to produce a signal corresponding to a weight-on-bit value. That is, once the torque versus WOB characteristic is known, then for any given torque, it is possible to determine a corresponding weight-on-bit. Thus, a weight-on-bit value, W, corresponding to a torque, T, in question can be determined from the torque versus WOB characteristic model and a corresponding signal generated and input into computer 16 of FIG. 1, or vice versa.

Alternatively, where signal series or families of series are being developed to provide complete advance guidelines for a particular bit, it may be helpful to define, from field data, a value, $\mu$, which varies with wear as follows:

$$\mu=(T-T_0)/(W-W_0) \tag{23}$$

where $T_0$=torque for threshold weight-on-bit; and $W_0$=threshold weight-on-bit.

The computer 16 can process signals corresponding to T, $T_0W_0$ and $\mu$ to perform the electrical equivalent of solving the equation given by:

$$W=((T-T_0)/\mu)+W_0 \tag{24}$$

Thus, a signal can be produced which is representative of the weight-on-bit corresponding to the torque in question.

Digressing for a moment, the present invention is further directed to an analysis system for providing information to a customer for use in selecting an appropriate bit (or bits) for a drilling operation of a given formation. Briefly, raw data from data logs can be electronically collected and processed by computer 16 of FIG. 1. From the data logs, lithology is calculated to determine the composition of the formation. In addition, porosity of the formation may also be calculated or measured from the log data. With a knowledge of lithology and porosity, rock strength can be calculated, as described more fully in copending application Ser. No. 08/621,412. Once rock strength is known, then the work that a particular bit of a given size and design must do to construct a well bore of a given interval in a given formation may be determined. With a knowledge of the work which the bit must do to construct a given well bore, then an intelligent decision may be made as to selecting the best bit for use in drilling the particular well bore. Determination of lithology, porosity, and rock strength thus involves log analysis based upon geology. With the alternate embodiment of the present invention, an analysis of torque versus weight-on-bit and bit mechanical efficiency is based upon drilling bit mechanics, rock strength, and operating torque of a drilling rig or drilling apparatus being used or considered for use in a particular drilling operation.

The present invention further provides an analysis system having the ability to provide information that heretofore has been previously unavailable. That is, with a knowledge of how much work a bit must do in drilling a bore hole of a given interval, the life of the bit may be accurately assessed. In addition to bit work, bit wear may be accurately assessed. Incremental work and incremental wear can further be plotted as a function of bore hole depth for providing a visually recognizable indication of the same. Still further, bit mechanical efficiency may also be more accurately assessed.

Returning now to the discussion of bit mechanical efficiency, mechanical efficiency can be defined as the ratio of torque that cuts over the total torque applied by the bit. The total torque includes cutting torque and frictional torque. Both cutting torque and frictional torque create bit wear, however, only cutting torque cuts the rock. When a bit is new, most of the torque goes towards cutting the rock. However, as the bit progressively wears, more and more torque goes to frictional torque. Stated differently, as the bit progressively wears, less and less of the torque cuts the rock. Eventually, none of the torque cuts the rock and the torque is entirely dissipated as friction. In the later instance, when there is only frictional torque, the bit is essentially rotating in the bore hole without any further occurrence of any cutting action. When the bit acts as a polished surface and does not cut, it will generate torque and eventually wear itself out.

As discussed earlier, mechanical efficiency can be estimated from measured operating parameters. Measured operating parameters include WOB, rotary rpm, penetration rate (corresponding to how fast the drill bit is progressing in an axial direction into the formation), and torque on bit (TOB, corresponding to how much torque is being applied by the bit). In addition, TOB may be estimated from the torque versus weight-on-bit model as discussed further herein. In addition, an actual mechanical efficiency may also be determined from the torque versus weight-on-bit model.

Let us now consider the relationship between the geometry of a drill bit and mechanical efficiency. A drill bit of given size and design can be designed on a computer using suitable known computer aided design software. The geometry of a drill bit includes the shape of cutters (i.e., teeth), the shape of a bit body or bit matrix, and placement of the cutters upon a bit body or bit matrix. Bit geometries may also include measurements corresponding to a minimum projected axial contact area for a cutter ($A_{axial\text{-}MIN}$), a maximum projected axial contact area for a cutter ($A_{axial\text{-}MAX}$), a maximum depth of cut ($d_{c\text{-}MAX}$) and cross-sectional area of the bit ($A_x$). See for example FIG. 11A.

Equipped with the geometry of a drill bit, such as having the bit geometry information and design data stored in the computer, bit mechanical efficiency may then be estimated at a given wear condition and a given rock strength. In other words, mechanical efficiency in any rock strength at any wear condition for a given bit can be calculated (i.e., predicted). With respect to the phrase "at any wear condition," there exists a theoretical wear condition after which the cutting teeth of the bit are worn to such an extent that mechanical efficiency becomes unpredictable after that. The theoretical wear condition may correspond to a point at which critical cutters (i.e. critical bit teeth) of the bit are worn down to the bit body or bit matrix. Assuming uniform wear, mechanical efficiency is theoretically determinable up to a theoretical one hundred percent (100%) wear condition. Thus, during the planning phase of a drilling operation, the mechanical efficiency for a particular bit can be estimated. According to the present invention, mechanical efficiency is estimated from the ratio of cutting torque to total torque, further as derived from the relationship of torque to WOB. From the geometries of a bit of given size and design and from the cumulative work-wear relationship of the bit, the corresponding torque versus WOB characteristic graph for a given rock strength can be constructed, as shown in FIG. 9.

Construction of the torque versus WOB graph of FIG. 9 will now be further explained, beginning with a brief review of basic drilling. For the formation of a bore hole, a drill bit is attached at the end of a drill string. The drill string is suspended from a drilling rig or drilling apparatus. Such a drill string may weigh hundreds of thousands of pounds. During an actual drilling operation, a drilling derrick may actually suspend a mile or two of pipe (drill string) into the bore hole with the drill bit attached to the end of the drill string. Weight-on-bit may be adjusted to a desired amount using various standard techniques known in the art. For example, if the drill string weighed 300,000 pounds, and a weight-on-bit of 20,000 pounds is desired, then the derrick is adjusted to suspend only 280,000 pounds. Suitable devices are also known for measuring weight-on-bit.

During actual drilling, there are at least two drilling parameters which can be controlled. One parameter is WOB, as discussed above. The other parameter is the rate at which the bit is turned, also referred to as rotary rpm (RPM).

The torque-versus-WOB characteristic model for a bit of given size and design can be generated as follows. Theoretically, beginning with a perfectly smooth, one hundred percent (100%) dull bit of the given size and design, the 100% dull bit is rotated on a rock or formation (having a given rock strength) at a given rpm (e.g., sixty (60) rpm). A gradual application of increasing WOB (beginning at zero WOB) is applied, wherein no drilling effect or cutting into the rock or formation occurs. This is because the bit is essentially dull and the bit does not penetrate into the rock. Spinning or rotating of the 100% dull bit with WOB thus results in a rate of penetration equal to zero (ROP=0). Torque is generated, however, even though the rate of penetration is zero. Torque may be plotted as a function of WOB to produce a torque versus WOB characteristic for the 100% dull bit. Such a torque versus WOB characteristic for the 100% dull bit is representative of a friction line, such as identified by reference numeral 160, in FIG. 9. At zero ROP, the rock is not being cut and the torque is entirely frictional torque.

Once the friction line 160 is determined, the torque versus WOB characteristic of a sharp bit can be obtained. The sharp bit is a bit of the given size and design in new condition. The sharp bit has geometries according to the particular bit design, for which the torque versus WOB characteristic model is being generated. One method of obtaining information for generating the torque versus WOB characteristic for the sharp bit is to rotate the drill string and sharp bit (e.g., at 60 rpm) just prior to the bit touching the bottom of the bore hole. WOB is gradually applied. A certain threshold WOB ($WOB_1$) must be applied for the sharp bit to just obtain a bite into the rock or formation. At that point, the threshold WOB is obtained and recorded, as appropriate. Once the sharp bit begins cutting into the rock, and with further gradual increase in WOB, the torque for the sharp bit follows a sharp bit torque versus WOB characteristic. The torque versus WOB characteristic for the sharp bit is shown and represented by the sharp bit cutting line, identified by reference numeral 170, in FIG. 9. While the sharp bit is cutting at a given rotary rpm and gradually increasing WOB, there will be a corresponding ROP, up to a maximum ROP. In addition, as the rock is being cut by the sharp bit, the torque applied by the bit includes both cutting torque ($T_c$) and frictional torque ($T_f$).

As shown in FIG. 9, the sharp bit cutting line 170 extends from an initial point 172 on the friction line 160 at the threshold WOB ($WOB_1$) to an end point 174 corresponding to a maximum depth of cut $d_c$ for the sharp bit, alternatively referred to as the maximum depth of cut point. The maximum depth of cut $d_c$ for the sharp bit corresponds to that point 174 on the sharp bit cutting line 170 at which the critical cutters of the sharp bit are cutting into the rock by a maximum amount. In addition, there is a corresponding torque on bit ($T_{dc\text{-}MAX}$) and weight on bit ($WOB_3$) for the maximum depth of cut point 174 of the sharp bit, as will be discussed further herein below.

For the torque versus WOB characteristic model, the operating torque ($T_{oper}$) of a drilling rig is represented by horizontal line 150 on the torque versus WOB graph of FIG. 9. Every drilling rig or drilling apparatus has a maximum torque output. That is, the drilling rig or apparatus can only apply so much rotary torque to a drilling string and bit as is physically possible for that particular drilling rig. Thus, effects upon mechanical efficiency as a consequence of the torque output of the particular drilling rig, and more particularly, maximum torque output, can be observed from the torque-versus-WOB characteristic model for a particular bit. The maximum value of the operating torque on bit $T_{oper}$ for the torque-versus-WOB characteristic model will thus be limited by the maximum torque output for the particular drilling rig being used or under consideration for use in a drilling operation.

For drilling operations, a safety factor is typically implemented in which the drilling rig is not operated at its maximum operating torque-on-bit, but rather at some optimum operating torque-on-bit different from the maximum operating torque-on-bit. An optimum operating torque-on-bit is preferably selected within a range typically less than or equal to the maximum operating torque for operational safety concerns. Selection of an optimum torque range from the graph of torque versus WOB provides for determination of an optimum operating WOB range. Referring again to FIG. 9, and with respect to the sharp bit cutting line 170, there is a corresponding maximum operating WOB ($WOB_2$) for the operating torque on bit according to the particular drilling rig being used or considered for use in a drilling operation.

For illustration purposes, an operating torque $T_{oper}$ is selected which occurs within an operating torque range. Referring again to FIG. 9, for the operating torque $T_{oper}$, there is a corresponding weight-on-bit $WOB_2$. When the sharp bit is cutting the rock, the total torque ($T_t$ equal to $T_{oper}$) includes cutting torque ($T_c$) and frictional torque ($T_f$). From the torque versus WOB characteristic model, the cutting torque ($T_c$) is that portion of the total torque which cuts the rock. The frictional torque (Tf) is that portion of the total torque which is dissipated as friction. With knowledge of the total torque ($T_{oper}$) and the frictional torque ($T_f$) from the torque versus WOB characteristic model, the cutting torque ($T_c$) can be readily determined (i.e., $T_c=T_{oper}-T_f$)

As the particular bit wears, the drilling operation will require an adjustment for more and more (i.e., increased) WOB in order for the bit to get a bite in the rock. Recall that bit wear can be measured using the cumulative work-wear model for the particular bit. The threshold WOB will need to be increased accordingly as the bit wears. Thus for a worn bit, the drilling operation will require a higher WOB than for the sharp bit. The required higher threshold weight-on-bit $WOB_3$ and a corresponding worn bit cutting line 180 are illustrated in FIG. 9. For the worn bit, the percentage of frictional torque increases (in greater proportion than for the sharp bit) and the percentage of cutting torque decreases (in greater proportion than for the sharp bit) with respect to a given total torque as WOB increases, as shown in FIGS. 8 and 9.

Construction of a torque versus WOB characteristic model for a bit of given size and design, as shown in FIG. 9, may be accomplished from the known geometries of the bit of given size and design. This is, for a given rock strength $\sigma$, further using known geometries of the bit of given size and design (as may be readily derived from a 3-dimensional model of the bit), the various slopes of the torque versus WOB characteristic model can be obtained. The slope of the friction line 160, the slope $\mu$ of the sharp bit cutting line 170, and the slope of the worn bit cutting line 180 may be calculated. For example, friction line 160 may be established using the procedure as indicated herein above. Furthermore, the bit geometries provide information about projected axial contact area $A_{axial}$ at a given depth of cut $d_c$ for both the sharp bit and the worn bit. For example, with information about the maximum axial projected contact area, the sharp bit cutting line upper limit torque value for maximum depth of cut, $T_{dc\text{-}MAX}$, end point 174 can be determined. Still further, threshold WOB ($WOB_1$) for the sharp bit and the threshold WOB ($WOB_3$) for the worn bit can also be determined based upon axial projected contact area of the sharp bit and the worn bit, respectively, as will be explained further herein below. Note that the threshold WOB value ($WOB_3$) of the worn bit is the same value as the WOB value of the sharp bit at end point 174 of the sharp bit cutting line, based upon the fact that the axial projected contact area of the worn bit at zero depth of cut is the same as the axial projected contact area of the sharp bit at maximum depth of cut.

Figure 10A:
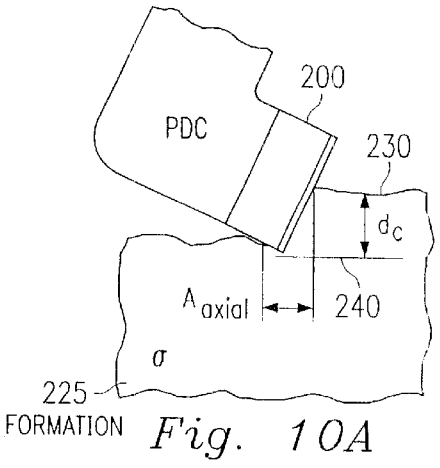
FIGS. 10A and 10B each illustrate an exemplary cutter (i.e., cutting tooth) of a drilling bit, a depth of cut, and an axial projected contact area.
Figure 10B:
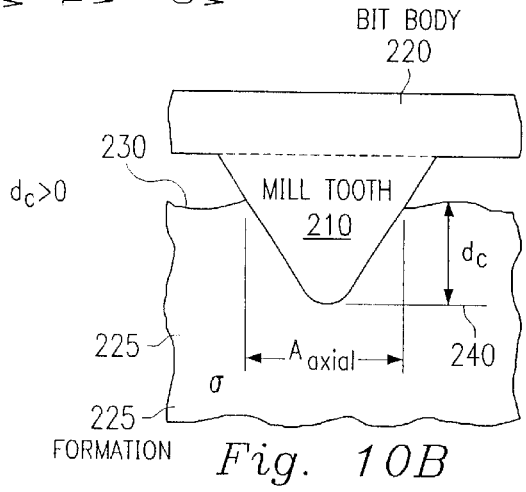

Referring now to FIGS. 10A and 10B, illustrative examples of drilling WOB are shown. FIG. 10A illustrates the effect of a drilling WOB for a PDC (polycrystaline diamond compact) cutter 200. FIG. 10B illustrates the effect of a drilling WOB for a milled tooth cutter 210. The cutters shown in FIGS. 10A and 10B each represent a simplified bit having one cutter tooth. Typically, a bit has a bit body 220 (or bit matrix) with many cutters on an exterior surface of the bit body. Likewise, a bit may only have one cutter. A bit may include tungsten carbide teeth inserted into a bit body matrix or a bit may include milled cutter teeth. Other types of bits are known in the art and thus not further described herein.

In FIGS. 10A and 10B, depth of cut ($d_c$) is shown for each type of bit cutter, further where the depth of cut is greater than zero ($d_c>0$). Depth of cut ($d_c$) is a measure of the depth of the embeddedness of a respective cutter into the rock 225 at a particular WOB. Depth of cut can thus be defined as the distance from an uppermost surface 230 of the rock being cut by an individual cutter to the lowermost contact surface 240 of the individual cutter embedded into the rock 225 being cut. Also illustrated in FIGS. 10A and 10B is an axial projected contact area $A_{axial}$ for each type of bit cutter. Axial projected contact area for each cutter is defined as an area of cutter contact which is axially projected upon the rock for a given depth of cut, where the area of cutter contact may change according to the respective depth of cut for a given WOB.

With respect to the torque versus WOB characteristic model, for any given bit, there is at least one cutter. In addition, for any given geometry of the bit, there will be a total axial projected contact area of that bit, the total axial projected contact area being a function of a respective depth of cut for a given WOB. Furthermore, the total axial projected contact area is the sum of axial projected contact areas of each cutter or tooth on the bit. Total axial projected contact area can change with a change in depth of cut.

The sharp bit cutting line 170 may be established using bit geometries beginning with a determination of the threshold WOB. The threshold WOB ($WOB_1$) is dependent upon the following relationship:

$$F/A_{axial}=\sigma, \text{ for a given } d_c \text{ (in FIG. 11, } d_c=0) \quad (25)$$

where force (F)=downward force applied to the bit;

$A_{axial}$=cumulative axial projected contact area;

$\sigma$=rock compressive strength; and $d_c$=depth of cut.

Figure 11A:
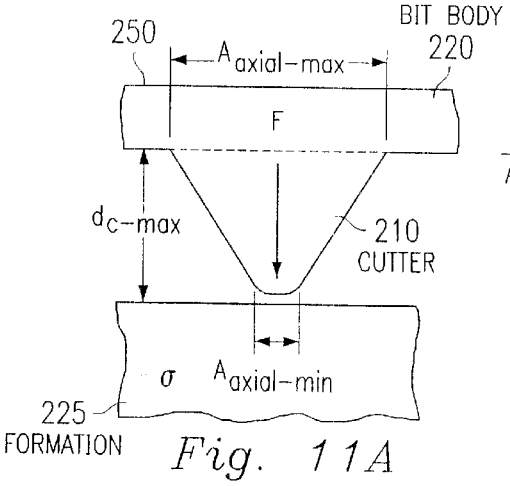
FIGS. 11A and 11B each illustrate bit mechanical geometries, including axial projected contact area, for use in determining a threshold weight-on-bit (WOB) for a given axial projected contact area and rock compressive strength.
Figure 11B:
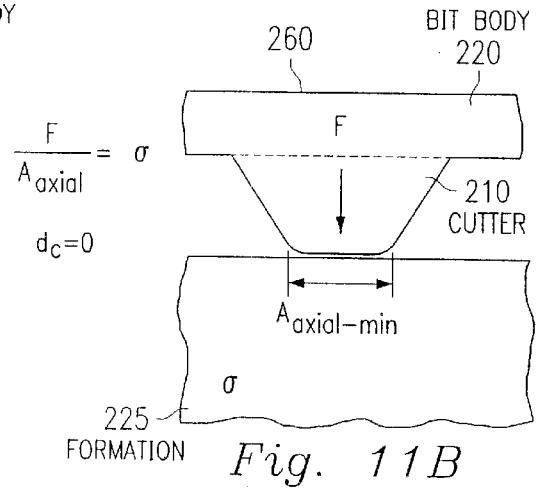

To further illustrate threshold WOB, in conjunction with FIGS. 9, 11A and 11B, suppose that the rock strength of a given formation is 10,000 psi, where rock strength is determined using a suitable method, for example, as discussed previously herein. Further, for simplicity, suppose that a sharp bit 250 includes the total axial projected contact area is one square inch (1 $in^2$) and that the bit is resting on the surface of a rock 225 but not yet penetrating into the rock (FIG. 11A). In order to just start or initiate a penetration into the rock, there first must be a force balance. For the force balance, there must exist an application of enough applied force that the force applied is equal to the resistance force. Then, a force greater than the force balance is needed to obtain the action of cutting into the rock. In our example, the resistance force is 10,000 psi, corresponding to the strength of rock. Thus, a WOB of at least 10,000 pounds must be applied to just initiate a penetration into the rock.

Consider now the instance of when the bit wears, for example, such that the worn bit 260 includes a total axial projected contact area of two square inches (2 $in^2$) as in FIG. 11B. For the worn bit 260 to just initiate a penetration into the rock 225, it requires 20,000 psi or double the WOB from the sharp bit having an axial projected contact area of one square inch. That is, 20,000 psi is required with an axial projected contact area of two square inches to obtain the force balance required before cutting can actually begin. Thus, all of the weight on bit which is required to just initiate penetration is dissipated as friction. This threshold WOB for the bit is the mechanism which distinguishes the frictional component of torque from the cutting component of torque.

As a bit wears, from sharp to worn, the mechanical efficiency of the bit changes. For example, the bit may start out with an axial projected contact area of one square inch. After cutting a certain increment, the bit may have worn to an axial projected contact area of two square inches, for example. The worn bit will dissipate more of the total torque as frictional torque than that of the sharp bit. The threshold WOB ($WOB_3$) for the worn bit is higher than that of the sharp bit ($WOB_1$). Total torque remains unchanged, however. As the bit wears, more and more of the total torque is dissipated as friction and less and less of it is cutting (see FIGS. 8 and 9). This effect on torque also influences ROP. That is, as the frictional torque increases, the ROP decreases since an increased portion of the total torque is being dissipated as friction and not as cutting torque.

The undesirable effects of increased frictional torque on ROP may be compensated for by speeding up or increasing the rotary rpm of the drill string, to a certain extent. As the bit tooth or cutter wears, there is a corresponding decrease in penetration per revolution. As the bit turns once, for increased wear, there is less and less cutter or tooth available to dig out the rock, thus less and less of the rock is dug out per revolution. However, if the bit is rotated faster, then the decreased ROP due to bit wear can be compensated for within a certain range. Also, rpm is limited by a maximum power limit at a given torque level. Once the bit dulls beyond a certain threshold amount, then compensating for decreased ROP by increased rpm becomes ineffective (under certain constraints and conditions) and the bit is needed to be replaced.

The above description thus highlights the underlying mechanism for the model of mechanical efficiency based upon the relationship of cutting torque to total torque. Recall that according to a prior method of determining mechanical efficiency, mechanical efficiency is a measure of rock strength divided by applied bit force. To further illustrate the difference between the prior definition and the definition as disclosed herein, consider the following. Suppose, for example, it is desired to drill a bore hole in sandstone having a rock strength of 10,000 psi. If the bore hole is drilled using an applied bit force of 20,000 psi, then twice as much force is being applied than is actually needed. The operating mechanical efficiency then is fifty percent (50%). Similarly, if a bit force of 10,000 psi is applied, then the mechanical efficiency would be one hundred percent 100%. For a mechanical efficiency of 100%, every ounce of force would be drilling the rock. This is mathematically equivalent to saying there is zero frictional torque. Zero frictional torque means that everything that is being applied to the bit is cutting the rock. In reality, 100% mechanical efficiency is not possible. There will always be something that is dissipated as friction.

The present invention recognizes a measure of mechanical efficiency as the ratio of cutting torque to total torque. Instead of rock strength and bit force, the present invention utilizes the percentage of torque that cuts (i.e., the percentage of cutting torque to total torque). Total torque applied to the bit is equal to the sum of cutting torque and frictional torque.

Let us now turn our discussion to the determination of cutting torque from a 3-D model of a bit of given size and design. As previously discussed, a 3-D model of the bit of given size and design can be stored in a computer. Use of the 3-D model bit can be simulated via computer, using mechanical simulation techniques known in the art. That is, the 3-D model of the bit can be manipulated to simulate drilling into rock of various rock strengths, from new bit condition to worn bit condition using the functional relationships discussed herein. The simulations can be performed for various rock strengths and various wear conditions, as will be further discussed herein below. Briefly, the 3-D model provides a set of parameters which include i) the friction line slope, ii) the sharp bit cutting line slope, iii) the worn bit cutting line slope, iv) the axial projected contact area for the sharp bit corresponding to its threshold WOB, v) the axial projected contact area for the worn bit corresponding to its threshold WOB, vi) a theoretical work rating for the bit, and vii) a wear characteristic which is a function of instantaneous axial projected contact area, the wear characteristic describing the rate of change of bit wear from the sharp bit cutting line to the worn bit cutting line as a function of cumulative work done for the particular bit.

From an analysis of the simulated drillings, torque versus WOB parameters can be determined. These parameters include slope of the friction line 160 slope of the sharp bit line 170 and slope of the worn bit line 180. In addition, the axial projected contact area for the sharp bit and the axial projected contact area of the worn bit are determined from the 3-D model (or bit geometries). Once the above parameters for the bit of given size and design have been determined, then the torque versus WOB characteristic model or graph can be constructed for any rock strength and any wear condition.

The axial projected contact area of a new (i.e., sharp) bit is determined by a geometric calculation. The axial projected contact area is a geometrical measurement based upon a placement of the cutters or teeth on the bit. The same is true for the axial projected contact area of the worn bit. The computer simulation determines the rate at which the slope $\mu$ changes from the sharp bit cutting line 170 to the worn bit cutting line 180 with increase in wear based upon a cumulative work-wear relationship of the particular bit of given size and design. The simulation furthermore determines the rate at which the bit becomes worn from the particular cumulative work-wear relationship.

The size of a bit and the number of cutters (i.e., number of cutting blades or teeth) contribute to the determination of the axial projected contact area for a sharp bit, as well as for a worn bit. More specifically, the total axial projection of the cutter contact area of cutters for a given bit is the sum of axial projections of each cutter of the bit which actually contacts the formation which is used. Recall the discussion of axial projected contact area with respect to FIGS. 10A and 10B. Axial projected contact area is further a measure of cutter contact area of cutters which actually contact the formation to be drilled. Total projected axial contact area for a sharp bit is less than the total cross-sectional area ($\pi r^2$) of the bit, where r is the radius of the bit in question.

Axial projected contact area may be even further better understood from the following discussion. For determination of threshold WOB, a new bit (i.e., sharp bit) may have an axial projected contact area $A_{axial}$ as shown in FIG. 11A, where the depth of cut is zero. Note that only one cutter or tooth is shown for simplicity. With an increase in WOB beyond the threshold WOB, further during cutting of the rock by the bit, the depth of cut will then be greater than zero but less than or equal to a maximum depth of cut for the particular cutter. During drilling, the cutter will be embedded into the rock by a certain amount and a corresponding change in the axial projected contact area of the cutter will occur. With a knowledge of the maximum axial projected contact area (e.g., at the maximum depth of cut ($d_{c\text{-}MAX}$) as shown in FIG. 11A) for a cutter, the upper limit torque value, $T_{dc\text{-}MAX}$, point 174 of the sharp bit cutting line 170 of the torque versus WOB graph, may be determined. That is, with knowledge of the maximum axial projected contact area ($A_{axial\text{-}MAX}$) of the bit and the rock strength, the force or WOB at the maximum axial projected contact area can be determined from equation (25). The WOB value at the maximum axial projected contact area of the bit also corresponds to the WOB value for the maximum depth of cut of the bit. Furthermore, with knowledge of the slope $\mu$, threshold WOB value, threshold torque value, and the WOB value for the maximum axial projected contact area, then the corresponding upper limit torque, $T_{dc\text{-}MAX}$, may be determined using equation (23) and solving for $T_{dc\text{-}MAX}$.

Axial projected contact area is the axial projection of the total 3-D shape of the bit onto the plane of the formation, which is a further function of the depth of cut ($d_c$). Axial projected contact area of a bit is the projection of the cutting structure onto the axial plane. Whatever engagement that the cutters have into the formation, the total axial contact area is the cumulative sum of the individual cutter axial projections according to each cutter's engagement into the rock being drilled. Axial contact area is then expressed as the sum of all of the incremental axial projected contact areas from the individual cutters on the bit (i.e., individual cutting elements or teeth).

As mentioned, the 3-D bit model is used to simulate drilling, generate the friction slope, generate the sharp cutting line slope, and generate the worn cutting line slope. The axial projected contact area for a given depth of cut of a bit can be determined from the geometries of the bit, such as might be obtained from a 3-D model of the bit which has been stored on a computer. A particular rock compressive strength can be provided, such as a rock compressive strength as measured from a particular formation or as selected for use with respect to torque versus WOB modeling purposes.

Maximum wear, corresponding to a theoretical maximum axial projected contact area for critical cutters of the bit of given size and design, can be determined from the geometries of the bit. That is, such a determination of a theoretical maximum axial projected contact area can be obtained from the geometries of the 3-D model of the bit. For instance, from the illustrations shown in FIGS. 11A and 11B, as the cutter wears, the axial projected contact area of an individual cutter may increase to a theoretical maximum amount, such as indicated by $A_{axial\text{-}MAX}$. Such a maximum amount can correspond to the axial projected contact area of the individual cutter when the cutter 210 is in a wear condition just prior to the cutter 210 being worn down to the bit body 220. If a cutter is worn down to 100% wear, then the bit body will contact the formation. At that point, the axial projected contact area of the cutter becomes the axial projected contact area of the bit body. In other words, as the bit wears, more particularly, the critical cutters $\mathbf{210}_c$ of the bit, the axial projected contact area of the critical cutters $\mathbf{210}_c$ increase to a maximum theoretical amount after which the axial projected contact area increases rapidly in an exponential manner. See FIGS. 12 and 13.

Figure 13:
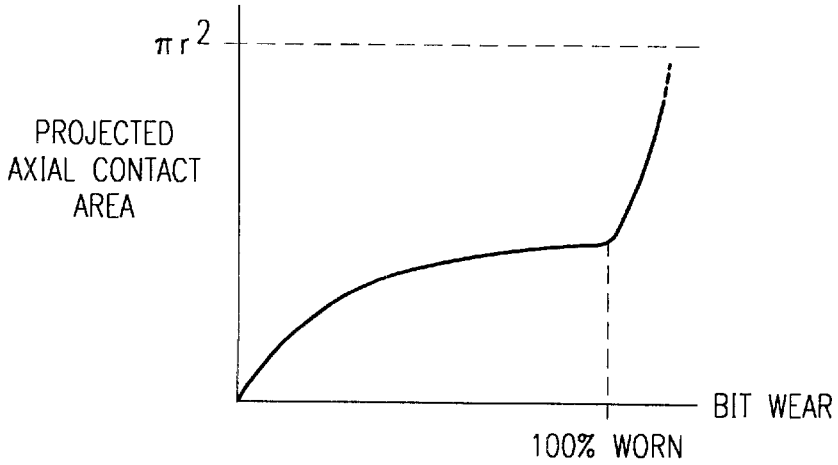
FIG. 13 shows an illustrative relationship between bit wear and projected axial contact area of the cutters of a bit of a given size and design.

At the instance that the axial projected contact area of the critical cutters becomes a theoretical maximum, any additional applied torque on bit is frictional torque. At such a point, there exists no further additional cutting torque since any additional applied torque is predominantly frictional. This results from the rapidly increased axial projected contact area contributed by the bit body. When the bit is sharp, such a rapid increase in axial projected contact area occurs when critical cutters of the bit are at a maximum depth of cut as indicated by reference numeral 174 in FIG. 9. The information thus gained from the sharp bit is used for determining a threshold WOB ($WOB_3$) for the worn bit, wherein the critical cutters of the worn bit are at a theoretical 100% wear condition. In other words, the 100% wear condition is a condition in which the cutting element is worn to the point such that the body of the bit is contacting the formation. Note that the bit body can be defined as anything that supports the cutting structure. Typically, some cutters of the cutting structure are more critical than others, also referred to as critical cutters $\mathbf{210}_c$. Thus, during bit wear, there will occur a sudden large increase in axial projected contact area to such an extent that all additional applied torque is frictional. This is due to a sudden discontinuity in the axial projected contact area as the cutters become more and more worn. An example of axial projected contact area versus bit wear is shown in FIG. 13.

Determination of the torque corresponding to the maximum depth of cut end-point 174 on the sharp bit cutting line 170 also provides for the determination of the minimum depth of cut point for the worn bit cutting line (i.e. threshold WOB, $WOB_3$). It is noted that the axial projected contact area of the sharp bit at maximum depth of cut per revolution is the same as the axial projected contact area for critical cutters of the worn bit. With the worn bit, cutting occurs by non-critical cutters of the worn bit until such time as no further cutting occurs and all additional applied torque is frictional.

The torque versus WOB model according to the present invention further emulates the rate at which the slope $\mu$ of the sharp bit cutting line 170 becomes the slope of the worn bit cutting line 180. There is a difference in the slope of the sharp bit cutting line and the worn bit cutting line. This difference is due to the ability of the sharp bit to cut more effectively than that of the worn bit. In addition, with respect to the torque versus WOB model, a maximum depth of cut per revolution is equivalent to a maximum penetration per revolution.

As discussed, for the occurrence of a sharp increase in axial projected contact area of the bit to occur, at least one cutter (or tooth) of the cutting structure is needed to wear down to a 100% worn condition. This is regardless of whether or not the remainder of cutters are engaging the rock formation to some extent. The sudden increase in axial projected contact area further results in additional torque being consumed as frictional torque. When all of the applied torque is frictional, then the bit is essentially used up and has reached the end of its useful life.

In further discussion of the above, the difference in slope is also due to the fact that, for the worn bit, there is a substantial increase in axial projected contact area over that of the sharp bit. Beyond the point of substantial increase in axial projected contact area, the bit is essentially used up.

Figure 12:
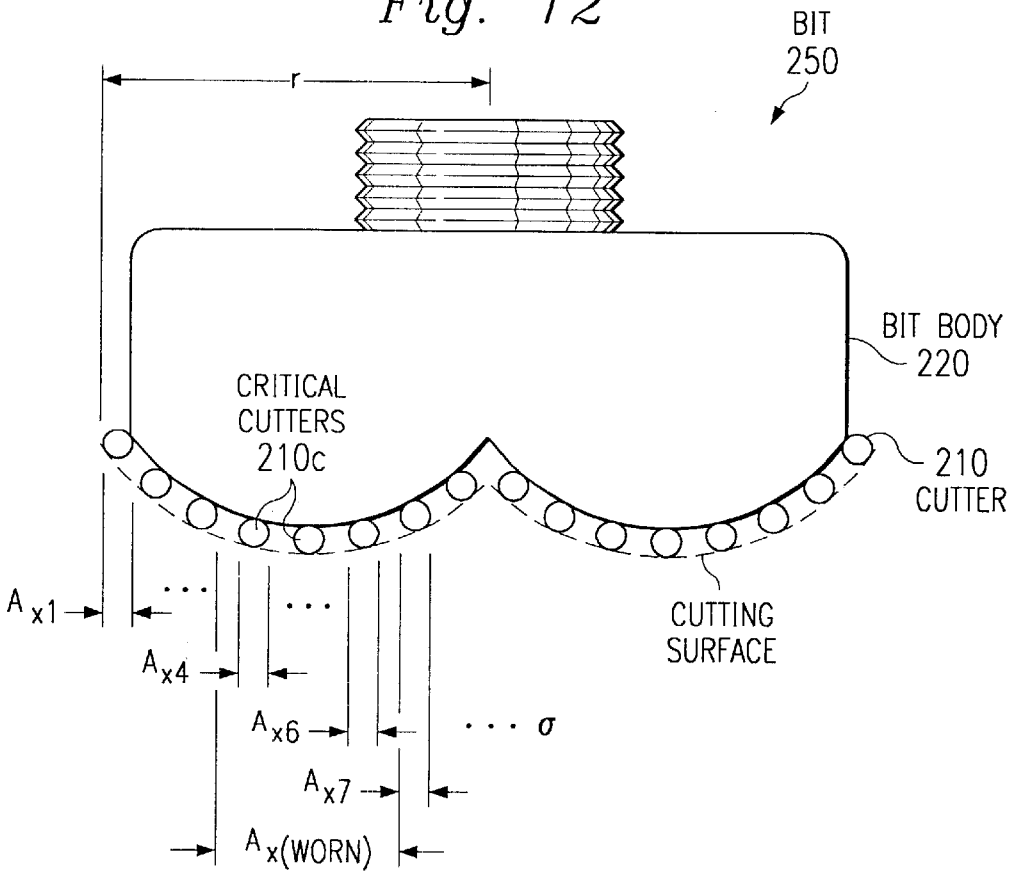
FIG. 12 illustrates an exemplary bit having cutters in contact with a cutting surface of a borehole, further illustrating axial contact areas of the cutters and critical cutters.

With reference to FIG. 12, a bit includes cutters all along a boundary of the tip of the bit, with some cutters 210 of the bit being referred to as critical cutters $\mathbf{210}_c$. Critical cutters $\mathbf{210}_c$ may not necessarily be on the crest of the tip of the bit. The critical cutters do the most work per revolution and therefore are exposed to the highest power level per revolution. Critical cutters thus wear out first, prior to other cutters on the bit. When the critical cutters $\mathbf{210}_c$ wear down to the bit body 220, such that the bit body 220 is in contact with the formation instead of the critical cutter, then the bit 250 is characterized as being 100% worn. While the bit is characterized as 100% worn, other cutters on the bit may be in relatively new condition, i.e., not worn very much. Thus, the present invention provides a much more accurate measure of bit wear in terms of bit mechanical efficiency.

Currently in the industry, the measure of bit wear is based upon the wear of an entire bit. Such a measure of wear based upon the entire bit can be misleading. Consider for example, an entire bit may only have 20% wear, however, if the critical cutters are worn out to the point where the formation is contacting the bit body (or bit matrix), then the bit is effectively useless. The present invention provides an improved measure of bit wear in terms of bit mechanical efficiency over prior wear measurement methods. With the present invention, when the critical cutters wear out, the bit has essentially finished its most useful life.

In conjunction with the cumulative work-wear relationship discussed above, a computer can be suitably programmed, using known programming techniques, for measuring the amount of work that it takes to wear the critical cutters of a bit of given size and design down to the bit body. The computer may also be used to generate the theoretical work rating of a bit of given size and design, as previously discussed herein. The theoretical work rating can be compared with an actual measured work done during actual drilling, and further compared to the actual wear condition. The actual wear condition and work can be input into the computer to history match the computer generated work rating model to what actually occurs. Thus, from a modeling of the bit wear, it is possible to determine an amount of work done during drilling of an interval and an actual wear condition of the bit, according to the present invention.

Modeling of the amount of work that a bit does (or the amount of work that a bit can withstand) before the bit must be replaced is advantageous. That is, knowing a given rock strength of a formation to be drilled, the amount of work a bit must do to form a desired interval of well bore can be calculated. Based upon the previous discussion, it is possible to simulate drilling with a bit of given size and design, and to determine the work done by the bit and a corresponding mechanical efficiency. Recall the example presented above with respect to FIGS. 11A and 11B for determining a threshold WOB for a sharp bit and a worn bit, wherein the axial projected contact area for the worn bit was double the axial projected contact area for the sharp bit. Consider now doubling the rock strength $\sigma$. As a result of doubling rock strength, the sharp bit cutting curve 170 will move up the friction line 160 to a new threshold WOB while maintaining its same slope. In addition, rock strength $\sigma$ changes another condition. That is, for a given distance or interval of well bore, rock strength $\sigma$ also has an effect on bit wear. Bit wear causes the slope of the sharp bit cutting line 170 to transform into the slope of the worn bit cutting line 180. These two phenomena occur simultaneously, i.e., changes to the threshold WOB and slope of the cutting line, which is not apparent from the prior art definition of mechanical efficiency. The present invention advantageously addresses the effect of rock strength and bit wear, in addition to the effect of operating torque of the drilling rig or apparatus, on bit mechanical efficiency.

Referring now to the discussion of mechanical efficiency, the prior art definition of mechanical efficiency indicates that rock strength has no effect on mechanical efficiency. However, the present invention recognizes that rock strength does have an effect on bit mechanical efficiency. One reason for this is that in the prior art, the effect of drilling rig torque output or operating torque was not known. The operating torque of the drilling rig (or drilling apparatus) is illustrated on the torque versus WOB characteristic graph of FIG. 9. The drilling rig may include a down hole motor, a top drive, or a rotary table, or other known drilling apparatus for applying torque on bit. There is thus a certain mechanical limitation of the mechanism which applies torque on bit and that mechanical limitation has a controlling effect on bit mechanical efficiency.

In a preferred embodiment, measurements (i.e., penetration rate, torque, etc.) are made ideally at the bit. Alternatively, measurements may be made at the surface, but less preferred at the surface. Measurements done at the surface, however, introduce uncertainties into the measurements, depending upon the parameter being measured.

As mentioned, a computer may be suitably programmed, using known programming techniques, for simulating drilling with a bit of given size and design, from sharp (new) to worn. The drilling may be simulated in one or more rocks of different compressive strengths, such as soft rock, intermediate rock, and hard rock. Such simulated drilling is based upon the geometries of the particular bit of given size and design and also based upon the rock strength of the formation of interest. With the geometries of the bit of interest and rock strength, the simulated drilling can determine wear condition and further determine mechanical efficiencies base upon the ratio of cutting torque to total torque. Geometries of the particular bit of given size and design include its shape, bit cross-sectional area, number of cutters, including critical cutters, axial projected contact area of individual cutters for a given depth of cut or WOB, total axial projected contact area for a given depth of cut or WOB, and maximum depth of cut for critical cutters. Such simulated drilling may be used for determining points on the torque versus weight on bit characteristic graph of the torque-mechanical efficiency model according to the present invention.

As discussed above, the computer may be used for running discrete simulations of wearing a bit from sharp (new) to worn as a function of work done, further at different rock strengths, to determine the slopes and rates of change of the slopes. For example, the computer may simulate drilling with a bit of given size and design for three different rock strengths, or as many as deemed necessary for the advance planing of a particular drilling operation. Such simulations using the torque-mechanical efficiency characteristic model according to the present invention provide for determination of mechanical efficiency with a particular bit of given size and design in advance of an actual drilling operation. Thus, not only can an appropriate bit be selected, but the effects of the particular drilling rig on mechanical efficiency can be analyzed in advance of the actual drilling operation.

The present invention thus provides a method for producing a suitable torque versus WOB characteristic model or signature for a particular bit of given size and design, further at various rock strengths. With various bits, a multitude of torque versus WOB signatures may be produced. The torque versus WOB signatures provide useful information in the selection of a particular bit for use in advance of actual drilling for a particular drilling operation. In addition, the effect of mechanical limitations of a particular drilling rig or apparatus on bit mechanical efficiency can also be taken into account during the process of selecting an appropriate bit for the particular drilling operation.

An example of a simulation of drilling with a bit from. sharp to worn can be as follows. Suppose that the simulation is drilling into rock having a strength of 5,000 psi. Knowing the bit geometries, the friction line of the torque versus WOB signature may be constructed, such as previously discussed. Next, the slope of the sharp bit cutting line may be determined, along with a threshold WOB for the given rock strength. With the threshold WOB for the sharp bit and the sharp bit cutting line slope, the sharp bit cutting line may then be constructed. The end point of the sharp bit cutting line is then determined using the maximum axial projected contact area. As the bit wears, the sharp bit cutting curve is transformed into the worn bit cutting curve. That is, the worn bit cutting curve may be determined from a knowledge of the sharp bit cutting curve and the bit wear. As discussed herein, bit wear is functionally related to cumulative work done by the bit, thus the amount of work done by the bit can be used for simulating bit wear. In addition, the bit is worn when the critical cutters are worn to the bit body or bit matrix. Thus, when the critical cutters are worn to the bit body, the simulation is completed. The simulation may then be used for producing an exponent which identifies, depending upon the cumulative amount of work done which can be obtained with knowledge of the rock strength, where the sharp bit cutting line slope occurs on the friction line and how fast the sharp bit cutting line slope is transformed into the worn bit cutting line slope as a function of cumulative work done (i.e., the rate of change of the slope of the sharp bit cutting bit line to the slope of the worn bit cutting line). As the bit does more and more work, more and more of the cutting structure of the bit is being worn away. The axial projected contact area changes from $A_{axial}$ (sharp) to $A_{axial}$ (worn). In this example, the simulation simulates how the bit performs in 5,000 psi rock.

In continuation of the above example, suppose now that the rock strength is 10,000 psi. Thus, instead of starting at the WOB threshold for 5,000 psi, the sharp cutting line begins at a little higher along the friction line at a higher WOB. In addition, the sharp cutting line transitions into the worn cutting line a little higher along the friction line. The torque versus WOB signature for various rock strengths can be similarly constructed. Rock strengths may also include 15,000, 20,000, . . . , up to 50,000 psi, for example. Other rock strengths or combinations of rock strengths are also possible. With a series of torque versus WOB signatures for various rock strengths for a particular bit of given size and design, it would be a simple matter to overlay the same and connect corresponding key points of each signature. In this way, no matter what the rock strength is and no matter what the wear condition is, mechanical efficiency of a bit of given size and design can be determined from the torque versus WOB characteristic model.

The present invention thus provides a useful analysis system, method and apparatus, for predicting mechanical efficiency of a bit of given size and design in advance of an actual drilling operation. The effects of mechanical limitations of a drilling rig (for use in the actual drilling operation) on mechanical efficiency are taken into account for a more accurate assessment of mechanical efficiency. The present invention may also be embodied as a set of instructions in the form of computer software for implementing the present invention.

While the discussion above emphasized predictive modeling of the mechanical efficiency, parameters may also be measured while actually drilling in a drilling operation. The results of the measured parameters may be compared to predicted parameters of the torque versus WOB characteristic model. If needed, coefficients of the predictive model may be modified accordingly until a history match is obtained.

With the ability to predict mechanical efficiency for a particular drilling operation from the torque versus WOB characteristic model, an optimal WOB can be determined for that particular drilling operation and mechanical efficiency. Mechanical efficiency defined as the percentage of torque that cuts further provides for a more accurate work-wear relationship for a particular bit of given size and design.

While the invention has been particularly shown and described with reference to specific embodiments thereof, it will be understood by those skilled in the art that various changes in form and detail may be made thereto, and that other embodiments of the present invention beyond embodiments specifically described herein may be made or practice without departing from the spirit of the invention, as limited solely by the appended claims.

What is claimed is:

1. A method of modeling torque versus weight-on-bit of a bit of given size and design for drilling in a formation of a given rock compressive strength, comprising the steps of:

providing geometries of the bit;

establishing a first characteristic curve representative of a friction line on a torque versus weight-on-bit graph for the bit at the given rock compressive strength, wherein the first characteristic curve is a function of the bit geometries;

establishing a second characteristic curve representative of a sharp bit cutting line on the torque versus weight-on-bit graph, wherein the second characteristic curve is a function of bit geometries and includes a slope which varies with bit wear according to a particular work-wear relationship of the bit; and establishing a third characteristic curve representative of a worn bit cutting line on the torque versus weight-on-bit graph, the third characteristic curve having a slope equal to the slope of the second characteristic curve with an adjustment in the slope according to a prescribed amount of wear of the bit, up to a maximum prescribed wear condition for the bit, wherein the torque versus weight-on-bit graph represents the torque versus weight-on-bit model of the bit of given size and design for drilling in the formation of given rock strength.

2. The method of claim 1, wherein the bit geometries include bit cross-sectional area and cutter geometries, further wherein the cutter geometries include a minimum axial projected contact area ($A_{axial\text{-}min}$), a maximum axial projected contact area ($A_{axial\text{-}max}$), and a maximum depth-of-cut ($d_{c\text{-}max}$), the sharp bit cutting line includes a first end-point on the friction line which is a function of a threshold weight-on-bit and second end-point which is a function of a maximum depth-of-cut, and the worn bit cutting line including a first end-point on the friction line at a WOB identified by the second end-point of the sharp bit cutting line.

3. The method of claim 1, further comprising the steps of:

providing a visually perceptible form of the torque versus weight-on-bit graph.

4. The method of claim 1, wherein the bit geometries are provided via a 3-dimensional bit model, and said steps of establishing the first, second, and third characteristic curves are carried out via a computer simulation.

5. An apparatus for modeling torque versus weight-on-bit of a bit of given size and design for drilling in a formation of a given rock compressive strength, comprising:

means for providing geometries of the bit;

means for establishing a first characteristic curve representative of a friction line on a torque versus weight-on-bit graph for the bit at the given rock compressive strength, wherein the first characteristic curve is a function of the bit geometries;

means for establishing a second characteristic curve representative of a sharp bit cutting line on the torque versus weight-on-bit graph, wherein the second characteristic curve is a function of bit geometries and includes a slope which varies with bit wear according to a particular work-wear relationship of the bit; and means for establishing a third characteristic curve representative of a worn bit cutting line on the torque versus weight-on-bit graph, the third characteristic curve having a slope equal to the slope of the second characteristic curve with an adjustment in the slope according to a prescribed amount of wear of the bit, up to a maximum prescribed wear condition for the bit, wherein the torque versus weight-on-bit graph represents the torque versus weight-on-bit model of the bit of given size and design for drilling in the formation of given rock strength.

6. The apparatus of claim 5, wherein the bit geometries include bit cross-sectional area and cutter geometries, further wherein the cutter geometries include a minimum axial projected contact area ($A_{axial\text{-}min}$), a maximum axial projected contact area ($A_{axial\text{-}max}$), and a maximum depth-of-cut ($d_{c\text{-}max}$), the sharp bit cutting line includes a first end-point on the friction line which is a function of a threshold weight-on-bit and second end-point which is a function of a maximum depth-of-cut, and the worn bit cutting line including a first end-point on the friction line at a WOB identified by the second end-point of the sharp bit cutting line.

7. The apparatus of claim 5, further comprising:

means for providing a visually perceptible form of the torque versus weight-on-bit graph.

8. The apparatus of claim 5, wherein the bit geometries are provided via a 3-dimensional bit model, and said means for establishing the first, second, and third characteristic curves includes computer simulation means for establishing the curves via a computer simulation.

9. A computer program stored on a computer readable medium for execution by a computer for modeling torque versus weight-on-bit of a bit of given size and design for drilling in a formation of a given rock compressive strength, said computer program comprising:

instructions for providing geometries of the bit;

instructions for establishing a first characteristic curve representative of a friction line on a torque versus weight-on-bit graph for the bit at the given rock compressive strength, wherein the first characteristic curve is a function of the bit geometries;

instructions for establishing a second characteristic curve representative of a sharp bit cutting line on the torque versus weight-on-bit graph, wherein the second characteristic curve is a function of bit geometries and includes a slope which varies with bit wear according to a particular work-wear relationship of the bit; and instructions for establishing a third characteristic curve representative of a worn bit cutting line on the torque versus weight-on-bit graph, the third characteristic curve having a slope equal to the slope of the second characteristic curve with an adjustment in the slope according to a prescribed amount of wear of the bit, up to a maximum prescribed wear condition for the bit, wherein the torque versus weight-on-bit graph represents the torque versus weight-on-bit model of the bit of given size and design for drilling in the formation of given rock strength.

10. The computer program of claim 9, wherein the bit geometries include bit cross-sectional area and cutter geometries, further wherein the cutter geometries include a minimum axial projected contact area ($A_{axial\text{-}min}$), a maximum axial projected contact area ($A_{axial\text{-}max}$), and a maximum depth-of-cut ($d_{c\text{-}max}$), the sharp bit cutting line includes a first end-point on the friction line which is a function of a threshold weight-on-bit and second end-point which is a function of a maximum depth-of-cut, and the worn bit cutting line including a first end-point on the friction line at a WOB identified by the second end-point of the sharp bit cutting line.

11. The computer program of claim 9, further comprising:

instructions for providing a visually perceptible form of the torque versus weight-on-bit graph.

12. The computer program of claim 9, wherein the bit geometries are provided via a 3-dimensional bit model, and said instructions for establishing the first, second, and third characteristic curves include instructions for establishing the curves via a computer simulation.

* * * * *